US011279580B2

(12) United States Patent
Miyagawa

(10) Patent No.: US 11,279,580 B2
(45) Date of Patent: Mar. 22, 2022

(54) SUCTION DEVICE, CONVEYOR, PRINTER, AND SUCTION REGION CHANGING DEVICE

(71) Applicant: Ricoh Company, Ltd., Tokyo (JP)

(72) Inventor: Hiroaki Miyagawa, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/155,360

(22) Filed: Jan. 22, 2021

(65) Prior Publication Data

US 2021/0237995 A1 Aug. 5, 2021

(30) Foreign Application Priority Data

Jan. 31, 2020 (JP) ..... JP2020-014524

(51) Int. Cl.
*B41J 13/22* (2006.01)
*B65H 5/22* (2006.01)
*B41J 13/00* (2006.01)

(52) U.S. Cl.
CPC ..... *B65H 5/222* (2013.01); *B41J 13/0018* (2013.01); *B65H 5/226* (2013.01); *B41J 13/226* (2013.01); *B65H 2406/332* (2013.01); *B65H 2406/361* (2013.01); *B65H 2406/362* (2013.01); *B65H 2406/3612* (2013.01); *B65H 2406/3622* (2013.01)

(58) Field of Classification Search
CPC .. B65H 5/222; B65H 5/226; B65H 2406/332; B65H 2406/361; B65H 2406/3612; B65H 2406/362; B65H 2406/3622; B41J 13/0018; B41J 13/226
See application file for complete search history.

(56) References Cited

U.S. PATENT DOCUMENTS 6,209,867 B1 * 4/2001 Madsen ..... B41J 11/0025 271/183
7,354,147 B2 * 4/2008 Beehler ..... B41J 11/0085 347/101
9,796,546 B1 * 10/2017 LeFevre ..... B41J 11/007
2020/0039772 A1 2/2020 Miyagawa

FOREIGN PATENT DOCUMENTS

JP 2013-240997 12/2013
JP 2013-241272 12/2013
JP 2020-019637 2/2020

* cited by examiner

*Primary Examiner* — Yaovi M Ameh
(74) *Attorney, Agent, or Firm* — Xsensus LLP

(57) ABSTRACT

A sheet suction device includes a bearing member configured to bear a sheet on a circumferential surface of the bearing member and rotate, a plurality of suction holes in a bearing region in the circumferential surface of the bearing member, a suction device connected to the plurality of suction holes, the suction device configured to suck the sheet through the plurality of suction holes, and a rotary valve between the bearing member and the suction device. The rotary valve includes: a first member communicating with the suction device, and a second member contacting the first member, the second member communicating with the plurality of suction holes. The first member includes a first groove on a side surface in a circumferential direction of the first member, the first groove communicating with the suction device.

16 Claims, 21 Drawing Sheets

SUCTION DEVICE, CONVEYOR, PRINTER, AND SUCTION REGION CHANGING DEVICE

CROSS-REFERENCE TO RELATED APPLICATION

This patent application is based on and claims priority pursuant to 35 U.S.C. § 119(a) to Japanese Patent Application No. 2020-014524, filed on Jan. 31, 2020, in the Japan Patent Office, the entire disclosures of which is hereby incorporated by reference herein.

BACKGROUND

Technical Field

Aspects of the present disclosure relate to a suction device, a conveyor, a printer, and a suction region changing device.

Related Art

A printer includes a rotation member such as a drum and performs printing while bearing a sheet on the drum to convey the sheet, for example.

A conveyor suctions and attracts the sheet on the drum to bear the sheet around a circumferential surface of the drum to convey the sheet.

For example, the conveyor includes a drum to suck and convey the sheet. The drum includes a plurality of suction holes formed on an entire circumferential surface of a support surface of the drum. The support surface of the drum supports the sheet. The drum includes three suction regions that suck an entire surface of the sheet. The drum further includes a plurality of suction parts that divide each suction region into a plurality of suction parts.

The conveyor includes a switching part between the plurality of suction parts and a negative pressure source. The switching part switches connection between each suction parts and the negative pressure source. The conveyor includes a controller to individually control a suction operation of the plurality of suction parts via a switching part based on a size of the sheet.

SUMMARY

In an aspect of this disclosure, a sheet suction device includes a bearing member configured to bear a sheet on a circumferential surface of the bearing member and rotate, a plurality of suction holes in a bearing region in the circumferential surface of the bearing member, a suction device connected to the plurality of suction holes, the suction device configured to suck the sheet through the plurality of suction holes, and a rotary valve between the bearing member and the suction device. The rotary valve includes a first member communicating with the suction device, and a second member contacting the first member, the second member communicating with the plurality of suction holes. The first member includes a first groove on a side surface in a circumferential direction of the first member, the first groove communicating with the suction device. The second member includes a plurality of holes on one side surface arranged in a row in a circumferential direction of the second member, the plurality of holes communicating with the plurality of suction holes, and a second groove on another side surface in the circumferential direction of the second member, the second groove communicating with at least one of the plurality of holes of the second member, and the first member is rotatable relative to the second member to change a number of the plurality of holes of the second member connected to the first groove of the first member to change a number of the plurality of suction holes communicating with the suction device.

In another aspect of this disclosure, a suction region changing device between a plurality of suction holes and a suction device is provided. The suction region changing device includes a first member communicating with the suction device, and a second member contacting the first member, the second member communicating with the plurality of suction holes. The first member includes a first groove on a side surface in a circumferential direction of the first member, the first groove communicating with the suction device. The second member includes a plurality of holes on one side surface arranged in a row in a circumferential direction of the second member, the plurality of holes communicating with the plurality of suction holes, and a second groove on another side surface in the circumferential direction of the second member, the second groove communicating with at least one of the plurality of holes of the second member, and the first member is rotatable relative to the second member to change a number of the plurality of holes of the second member connected to the first groove of the first member to change a number of the plurality of suction holes communicating with the suction device.

In still another aspect of this disclosure, a sheet suction device includes a bearing member configured to bear a sheet on a circumferential surface of the bearing member and rotate, a plurality of suction holes in a bearing region in the circumferential surface of the bearing member, a suction device connected to the plurality of suction holes, the suction device configured to suck the sheet through the plurality of suction holes, and a rotary valve between the bearing member and the suction device. The rotary valve includes a first member communicating with the plurality of suction holes, and a second member contacting the first member, the second member communicating with the suction device. The first member includes a plurality of holes on one side surface arranged in a row in a circumferential direction of the first member, the plurality of holes communicating with the plurality of suction holes, and a first groove on another side surface in the circumferential direction of the first member, the first groove communicating with at least one of the plurality of holes of the first member. The second member includes a second groove on a side surface in a circumferential direction of the second member, the second groove communicating with the suction device. The second member is rotatable relative to the first member to change a number of the plurality of holes of the first member connected to the second groove of the second member to change a number of the plurality of suction holes communicating with the suction device.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
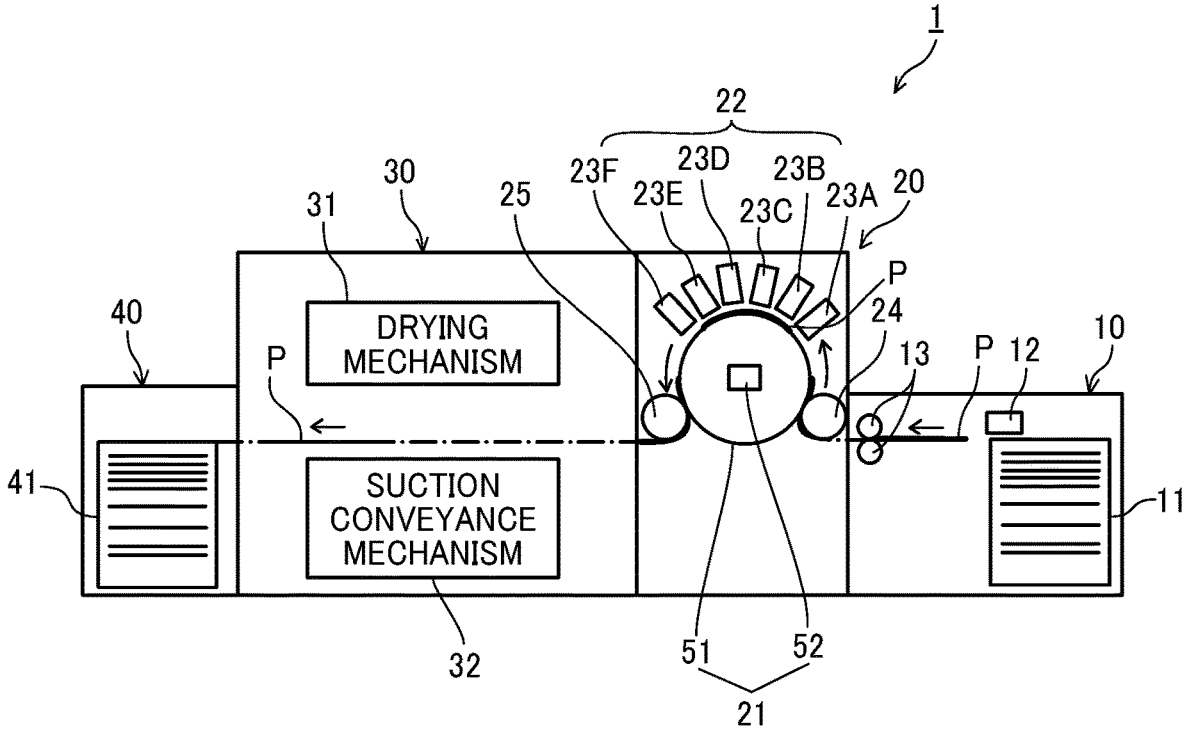
FIG. 1 is a schematic side view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. Next, a printer 1 according to a first embodiment of the present disclosure is described with reference to FIGS. 1 and 2.

FIG. 1 is a schematic side view of the printer 1 according to the first embodiment of the present disclosure.

Figure 2:
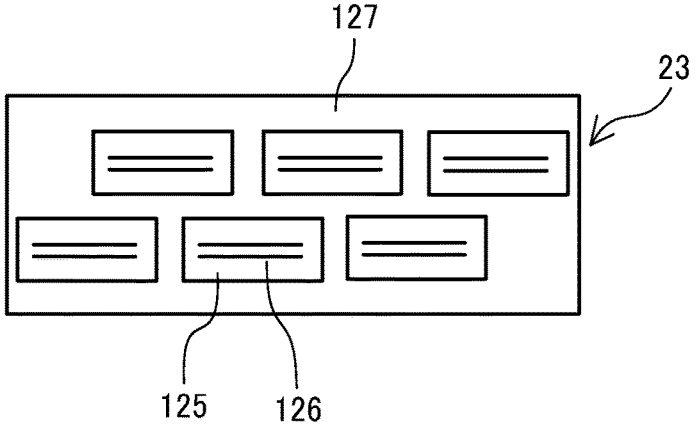
FIG. 2 is a plan view of a discharge unit of the printer.

FIG. 2 is a plan view of an example of a discharge unit 23 of the printer 1.

The printer 1 includes a loading device 10, a printing device 20, a drying device 30, and an ejection device 40. The printer 1 applies a liquid to a sheet P conveyed from the loading device 10 by the printing device 20 to perform required printing, dries the liquid adhering to the sheet P by the drying device 30, and ejects the sheet P to the ejection device 40.

The loading device 10 includes a loading tray 11 on which a plurality of sheets P are stacked, a feeding device 12 to separate and feed the sheets P one by one from the loading tray 11, and a resist roller pair 13 to feed the sheet P to the printing device 20.

Any feeder such as a device using a roller or a device using air suction may be used as the feeding device 12. The sheet P delivered from the loading tray 11 by the feeding device 12 is delivered to the printing device 20 by the resist roller pair 13 being driven at a predetermined timing after a leading end of the sheet P reaches the resist roller pair 13.

The printing device 20 includes a sheet conveyor 21 to convey the sheet P. The sheet conveyor 21 includes a drum 51 and a suction device 52. The drum 51 is a bearing member (rotating member) that bears the sheet P on a circumferential surface of the drum 51 and rotates. The suction device 52 generates a suction force on the circumferential surface of the drum 51. The printing device 20 includes a liquid discharge device 22 that discharges the liquid toward the sheet P borne on the drum 51 of the sheet conveyor 21 to apply the liquid onto the sheet P.

The printing device 20 further includes a transfer cylinder 24 and a delivery cylinder 25. The transfer cylinder 24 receives the sheet P fed from the resist roller pair 13 and transfers the sheet P to the drum 51. The delivery cylinder 25 delivers the sheet P conveyed by the drum 51 to the drying device 30.

A leading end of the sheet P conveyed from the loading device 10 to the printing device 20 is gripped by a sheet gripper provided on a surface of the transfer cylinder 24 and is conveyed in accordance with a rotation of the transfer cylinder 24. The transfer cylinder 24 forwards the sheet P to the drum 51 at a position opposite (facing) the drum 51.

Similarly, the drum 51 includes a sheet gripper on a surface of the drum 51, and the leading end of the sheet P is gripped by the sheet gripper of the drum 51. A plurality of suction holes is dispersedly formed on the surface of the drum 51. The suction device 52 generates a suction airflow from a desired plurality of suction holes of the drum 51 toward an interior of the drum 51. The suction device 52 serves as a suction device.

The sheet gripper 106 (see FIG. 4) of the drum 51 grips the leading end of the sheet P forwarded from the transfer cylinder 24 to the drum 51, and the sheet P is attracted to and borne on the drum 51 by the suction airflows by the suction device 52. As the drum 51 rotates, the sheet P is conveyed.

The liquid discharge device 22 includes discharge units 23 (23A to 23F) to discharge liquids of each color, for example, yellow (Y), cyan (C), magenta (M), and black (K). The liquid discharge device 22 serves as a liquid discharge device. For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K), respectively.

Further, the discharge units 23E and 23F are used to discharge any one of YMCK or special liquid such as white and gold (silver). Further, the liquid discharge device 22 may further include a discharge unit to discharge a processing liquid such as a surface coating liquid.

The discharge unit 23 is a full line head and includes a plurality of liquid discharge heads 125 arranged in a staggered manner on a base 127 (see FIG. 2). Each of the liquid discharge head 125 includes a plurality of nozzle arrays 126 and a plurality of nozzles arranged in each of the nozzle arrays 126, for example as illustrated in FIG. 2. Hereinafter, the "liquid discharge head" is simply referred to as a "head."

A discharge operation of each of the discharge units 23 of the liquid discharge device 22 is controlled by drive signals corresponding to print information. When the sheet P borne on the drum 51 passes through a region facing the liquid discharge device 22, the liquid of each color is discharged from the discharge units 23, and an image corresponding to the print information is printed on the sheet P.

The drying device 30 includes a drying mechanism 31 and a suction conveyance mechanism 32. The drying mechanism 31 dries the liquid adhered on the sheet P by the printing device 20. The suction conveyance mechanism 32 conveys (suctions and conveys) the sheet P while suctioning the sheet P conveyed from the printing device 20 onto the suction conveyance mechanism 32.

After the sheet P conveyed from the printing device 20 is received by the suction conveyance mechanism 32, the sheet P is conveyed to pass through the drying mechanism 31 and delivered to the ejection device 40.

When the sheet P passes through the dying mechanism 31, the liquid on the sheet P is subjected to a drying process by the drying mechanism 31. Thus, the liquid component such as water in the liquid evaporates. The colorant contained in the liquid is fixed on the sheet P. Thus, curling of the sheet P is reduced.

The ejection device 40 includes an ejection tray 41 on which a plurality of sheets P are stacked. The sheets P conveyed from the drying device 30 are sequentially stacked and held on the ejection tray 41 of the ejection device 40.

The printer 1 can further include, for example, a pretreatment device disposed upstream from the printing device 20, or a post-processing device disposed between the drying device 30 and the ejection device 40. The pretreatment device performs pretreatment on the sheet P. The post-processing device performs post-processing of the sheet P to which the liquid adheres.

For example, the pre-processing device may perform a pre-application process that applies a treatment liquid onto the sheet P before image is printed on the sheet P. The treatment liquid reacts with the liquid to reduce bleeding of the liquid to the sheet P. However, the content of the pre-application process is not particularly limited to the process as described above. Further, the post-processing device may perform a sheet reversing process and a binding process to bind a plurality of sheets P, for example. The sheet reversing process reverses the sheet P, on which image is printed by the printing device 20, and conveys the reversed sheet P again to the printing device 20 to print on both sides of the sheet P.

The printing device 20 according to the first embodiment includes the discharge unit 23 to discharge a liquid. However, the printing device 20 according to the first embodiment may perform printing by a method other than the liquid discharge operation such as an electrographic method.

The sheet suction device 50 according to a first embodiment of the present disclosure is described with reference to FIG. 3.

Figure 3:
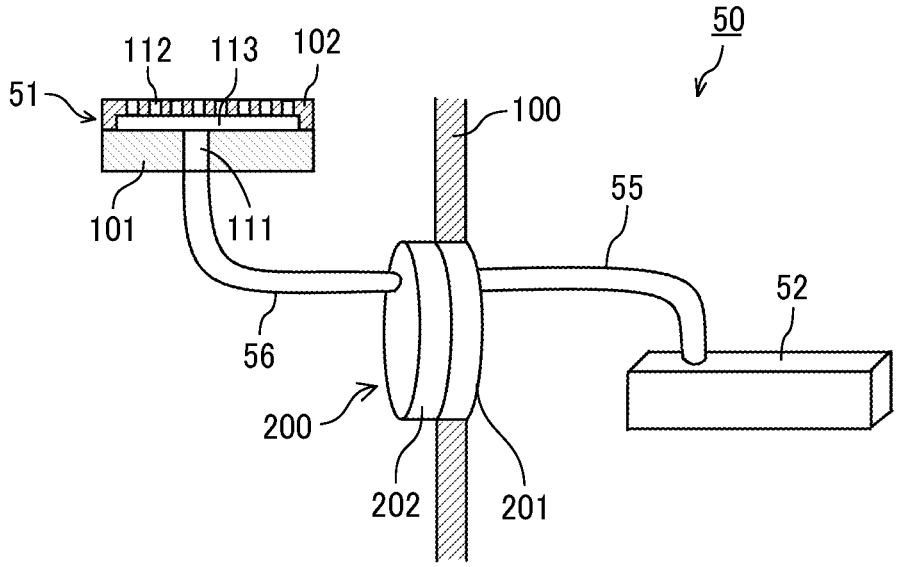
FIG. 3 is a schematic side view of an entire configuration of a sheet suction device according to the first embodiment of the present disclosure.

FIG. 3 is a schematic side view of an entire structure of a sheet suction device 50 of the printer 1.

The sheet suction device 50 includes a drum 51, a suction device 52 as a suction device, and a rotary valve 200 as a suction region changing device arranged between the drum 51 and the suction device 52. The suction device 52 and the rotary valve 200 are connected with each other via a hose 55 (tube), and the rotary valve 200 and the drum 51 are connected with each other via a hose 56 (tube).

Next, the drum 51 according to the first embodiment is described with reference to FIGS. 4 to 7.

Figure 4:
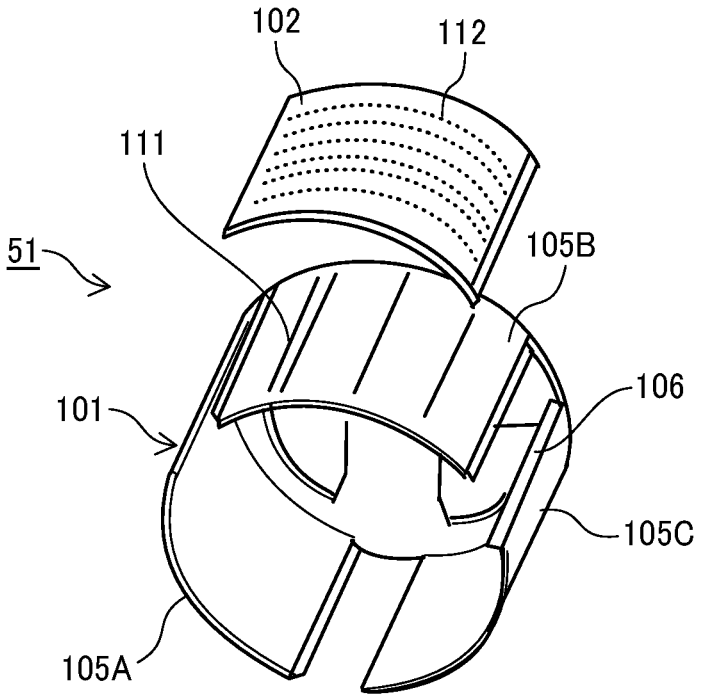
FIG. 4 is an exploded perspective view of a drum of the sheet suction device.

FIG. 4 is an exploded perspective view of the drum 51.

Figure 5:
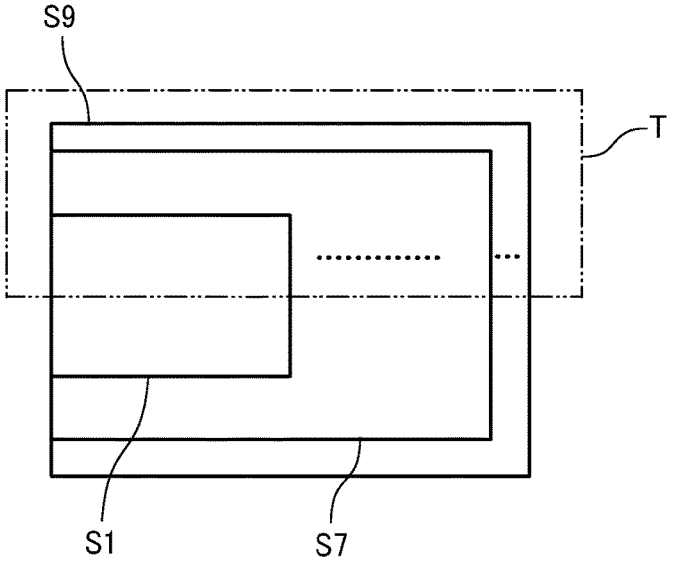
FIG. 5 is a plan view of the drum illustrating a sheet size in one bearing region of the drum.

FIG. 5 is a plan view of the drum 51 illustrating a sheet size in one bearing region 105 of the drum 51.

Figure 6:
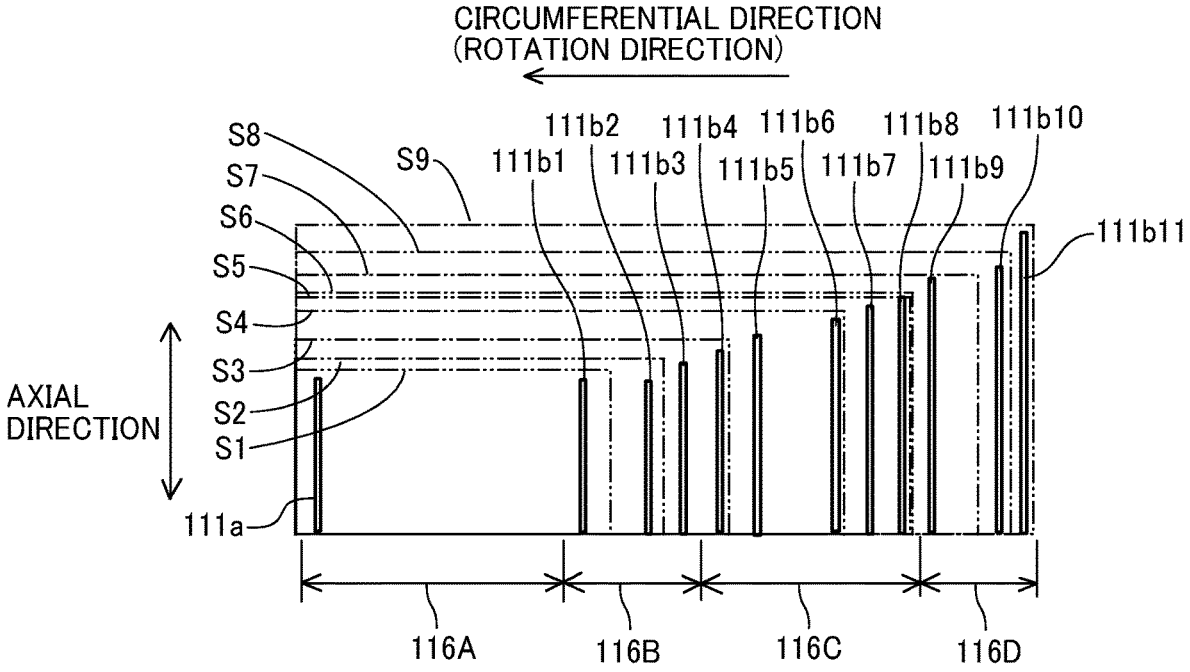
FIG. 6 is an enlarged schematic plan view of a T-portion of FIG. 5 illustrating an arrangement of suction ports and the sheet size in a circumferential direction of the drum 51.

FIG. 6 is an enlarged schematic plan view of a T-portion of FIG. 5 illustrating an arrangement of suction ports and the sheet size in a circumferential direction of the drum 51.

Figure 7:
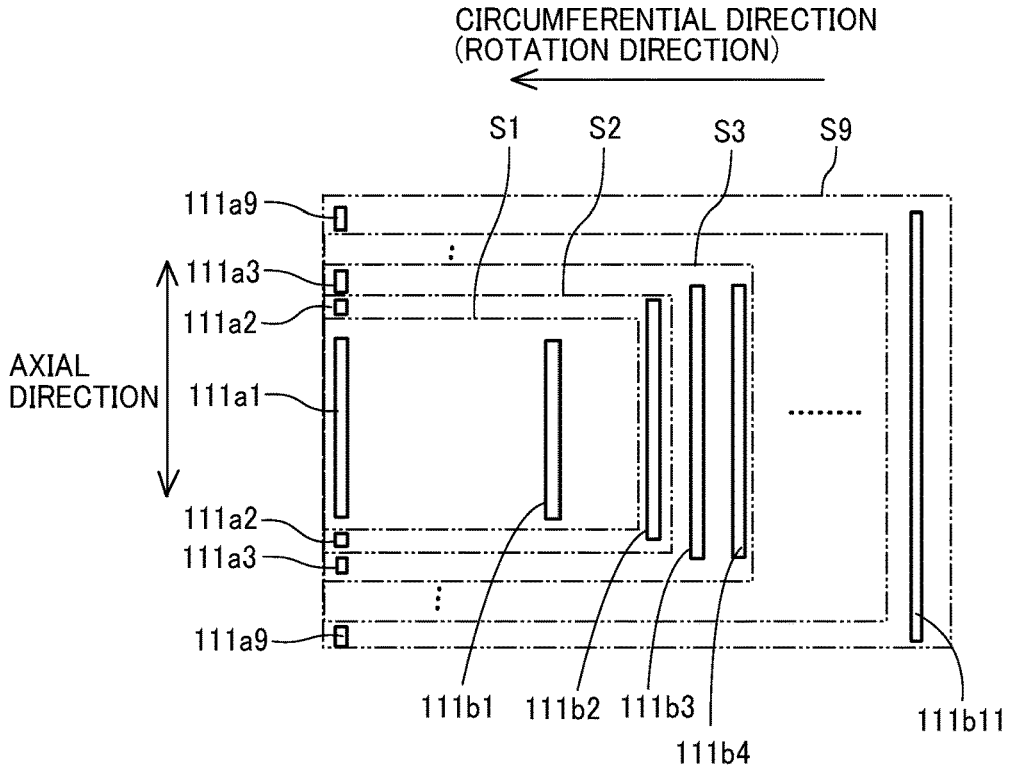
FIG. 7 is an enlarged schematic plan view of the drum illustrating an arrangement of the suction ports in an axial direction and the circumferential direction of the drum, and the sheet size.

FIG. 7 is an enlarged schematic plan view of the drum 51 illustrating the arrangement of the suction ports in an axial direction and the circumferential direction of the drum 51, and the sheet size.

Figure 8:
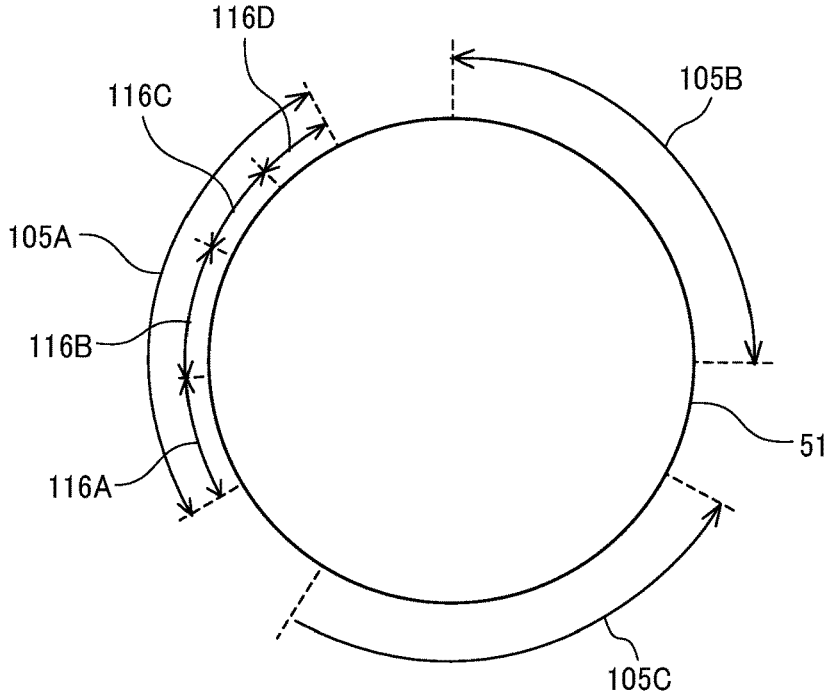
FIG. 8 is a schematic side view of the drum illustrating the bearing region and divided regions of the bearing region.

FIG. 8 is a schematic side view of the drum 51 illustrating the bearing region 105 and divided regions of the bearing region 105.

The drum 51 includes a drum body 101 and a suction plate 102. A sealing material such as a rubber sheet may be interposed between the suction plate 102 and the drum body 101.

The drum 51 includes three bearing regions 105 (105A to 105C) and is bearable a plurality of sheets P in the circumferential direction of the drum 51. As illustrated in FIGS. 3 and 4, the drum 51 includes three suction plates 102 for the bearing regions 105A to 105C and the drum body 101. The drum body 101 includes three bearing regions 105A to 105C.

The suction plate 102 includes a plurality of suction holes 112 and forms a chamber 113 communicating with each of the suction holes 112. The drum body 101 includes a groove shaped suction ports 111 communicating with the chamber 113. The drum 51 includes a sheet gripper 106 at a leading end of the bearing region 105 in a rotation direction of the drum 51. The sheet gripper 106 is illustrated in a simplified manner in FIG. 4.

As illustrated in FIGS. 5 and 6, sheet areas S1 to S9 corresponding to a plurality of sheet sizes (nine sheet sizes in the present embodiment) are allocated to one bearing region 105, and twelve suction ports 111*a* and 111*b*1 to 111*b*11 are arranged in the circumferential direction in the one bearing region 105. As illustrated in FIG. 7, the suction port 111 includes suction ports 111*a*1 to 111*a*9 arranged in the axial direction (vertical direction in FIG. 7) at the leading end in the rotation direction (left end in FIG. 7). The suction ports 111*a*1 to 111*a*9 respectively correspond to the sheet sizes S1 to S9.

For example, the drum 51 includes the suction ports 111*a*1 and 111*b*1 corresponding to the sheet region S1 (see FIGS. 6 and 7). The suction ports 111*a*1 and 111*b*1 communicate with the chamber 113 to which the plurality of suction holes 112 faces. The drum 51 includes the suction ports 111*a*2 and 111*b*2 communicating with the chamber 113 to which a plurality of suction holes 112 in the sheet region S2 excluding the sheet region S1 faces.

The drum 51 includes the suction ports 111*a*3, 111*b*3, and 111*b*4 communicating with the chamber 113 to which a plurality of suction holes 112 in the sheet region S3 excluding the sheet regions S1 and S2 faces. The same applies to other sheet regions S4 to S9.

As illustrated in FIG. 8, one bearing region 105A is divided into a first region 116A, a second region 116B, a third region 116C, and a fourth region 116D in the circumferential direction (rotational direction) from a leading end side in the circumferential direction (rotational direction) of the drum 51. Here, the drum 51 rotates counterclockwise as indicated by arrows in FIG. 1.

As illustrated in FIG. 6, the first region 116A is allocated to the suction port 111*a* at the leading end (left end in FIG. 6) in the circumferential direction (rotation direction) of the drum 51 as indicated by arrow in FIG. 6. The circumferential direction (rotation direction) is leftward direction in FIG. 6. The second region 116B is allocated to the suction ports 111*b*1 to 111*b*3. The third region 116C is allocated to the suction ports 111*b*4 to 111*b*8. The fourth region 116D is allocated to the suction ports 111*b*9 to 111*b*11.

Thus, the sheet suction device 50 can connect the hose 56 (tube) to each suction port 111 (111*a* and 111*b*) on the drum 51 and switch (change) a generation of the negative pressure to each suction port 111 (111*a* and 111*b*) to switch (change) the suction regions.

As illustrated in FIG. 3, the rotary valve 200 includes a rotation part 202 that rotates with the drum 51 and a fixing part 201 connected to the suction device 52 and does not rotate with the drum 51.

Thus, the rotary valve 200 can switch (change) a connection and a disconnection between the suction hole 112 and the suction device 52 according to a relative phase difference between the rotation part 202 and the fixing part 201 to control timing of generation of the negative pressure on the circumferential surface of the drum 51 (see FIG. 3).

Thus, the rotary valve 200 connects or disconnects the suction hole 112 and the suction device 52 to switch (change) the connection between the suction hole 112 and the suction device 52. Generally, a metal plate processed into a disk shape is used for both the rotation part 202 and the fixing part 201. A metal plate coated with resin, for example, is generally used for a sliding surface of the rotation part 202.

FIGS. 9 to 15 illustrates the rotary valve 200 according to a first embodiment of the present disclosure.

Figure 9:
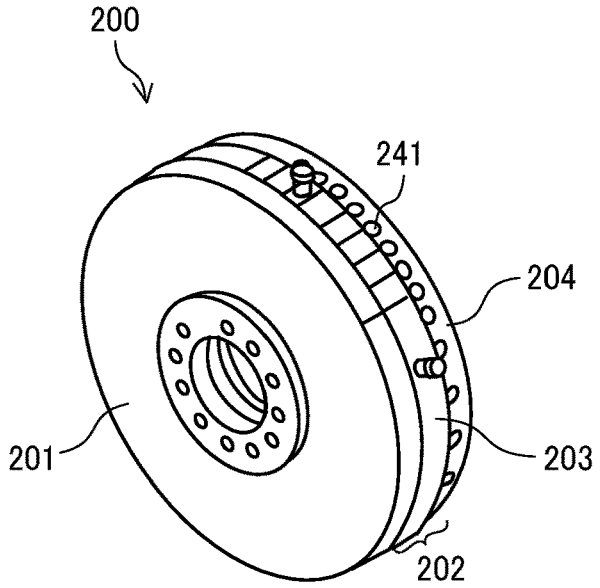
FIG. 9 is an external perspective view of a rotary valve according to a first embodiment of the present disclosure.

FIG. 9 is a schematic external perspective view of the rotary valve 200.

Figure 10:
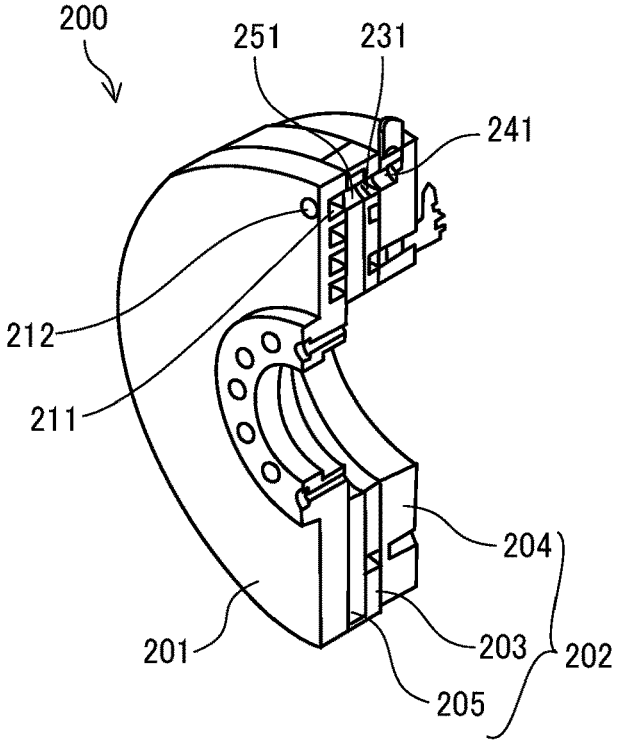
FIG. 10 is a schematic cross-sectional perspective view of the rotary valve cut in half.

FIG. 10 is a schematic cross-sectional perspective view of the rotary valve 200 cut in half.

Figure 11:
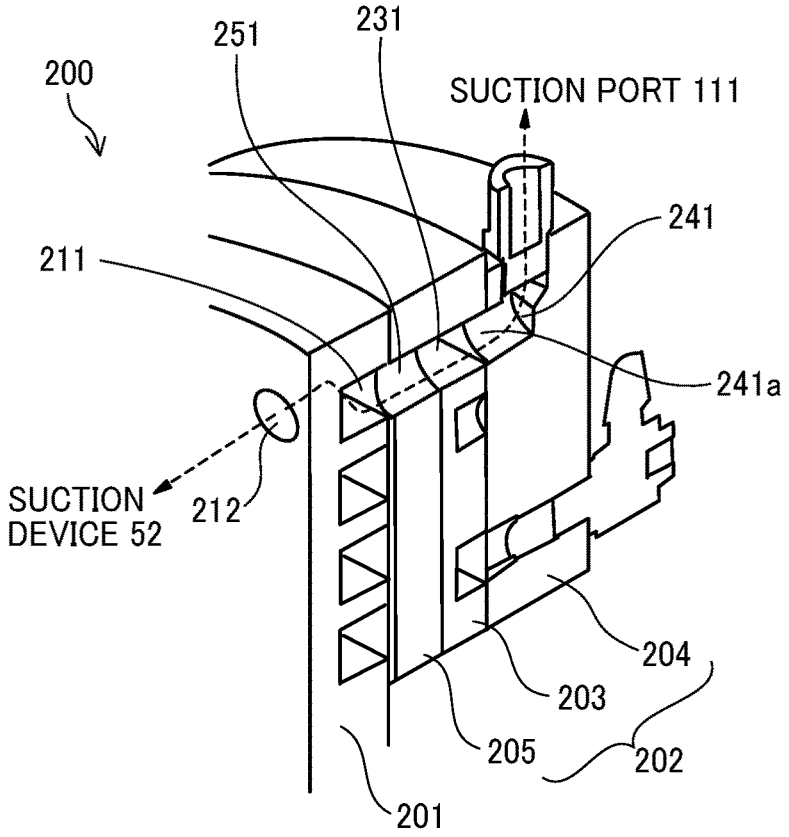
FIG. 11 is a schematic enlarged cross-sectional perspective view of a main part of the rotary valve cut in half.

FIG. 11 is a schematic enlarged cross-sectional perspective view of a main part of the rotary valve 200 cut in half.

Figure 12A:
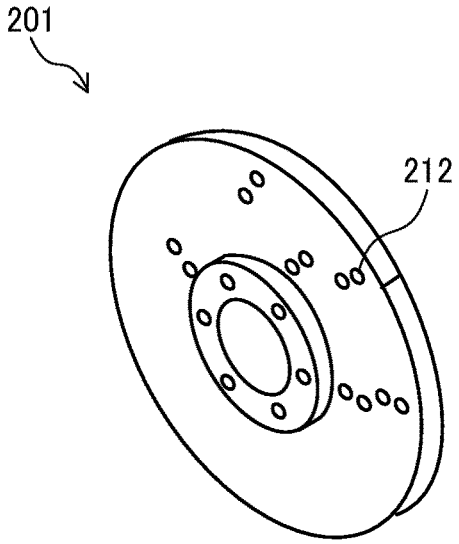
FIGS. 12A and 12B are schematic perspective views of the fixing part that configures the rotary valve.
Figure 12B:
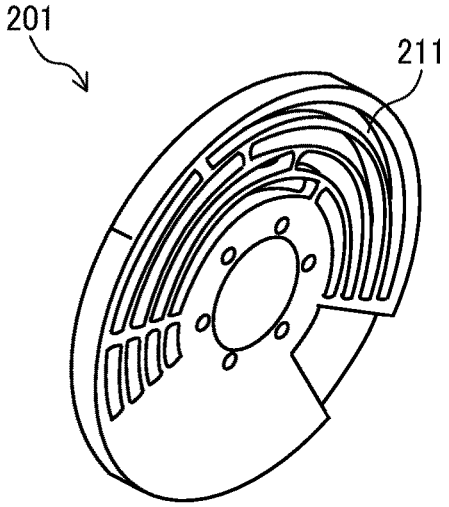

FIGS. 12A and 12B are schematic perspective views of the fixing part 201 that forms the rotary valve 200.

Figure 13:
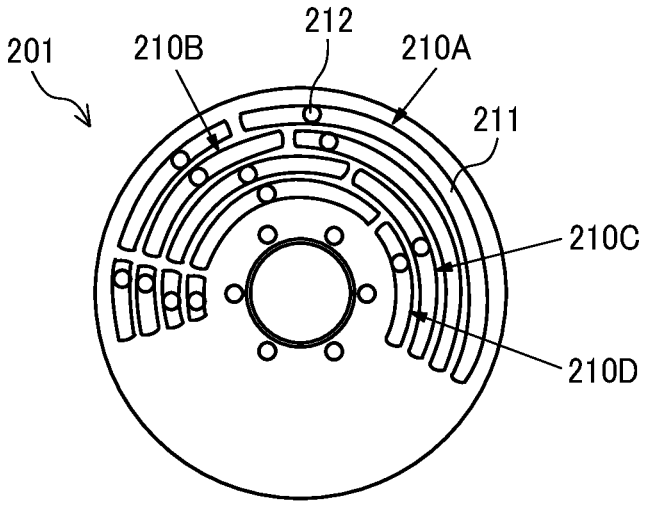
FIG. 13 is a schematic side view of the fixing part.

FIG. 13 is a schematic side view of the fixing part 201.

Figure 14A:
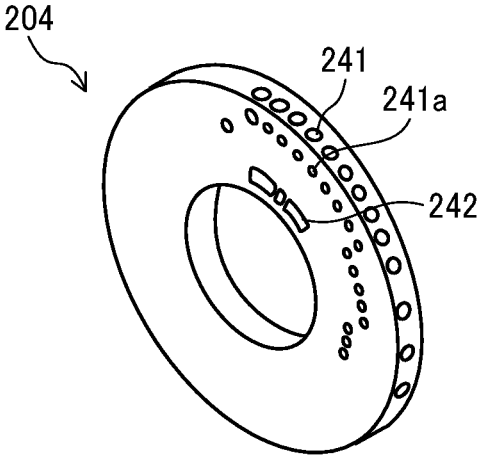
FIGS. 14A and 14B are schematic perspective views of a second member that configures the rotary valve.
Figure 14B:
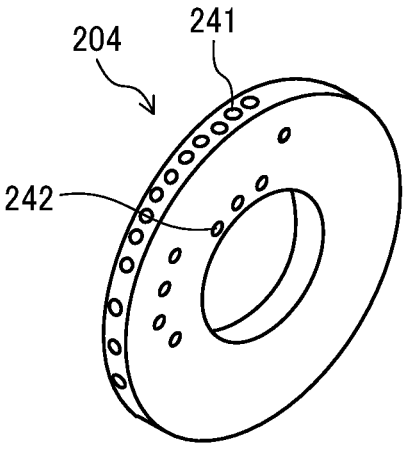

FIGS. 14A and 14B are schematic perspective views of a second member 204 that forms the rotary valve 200.

Figure 15:
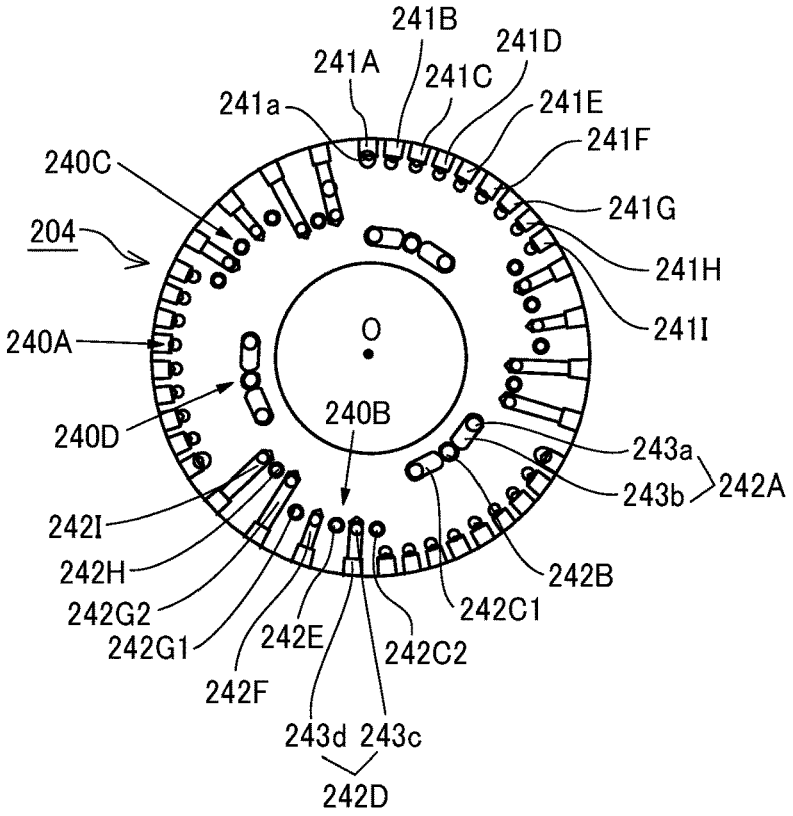
FIG. 15 is a schematic side view of the second member.

FIG. 15 is a schematic side view of the second member 204.

Figure 16A:
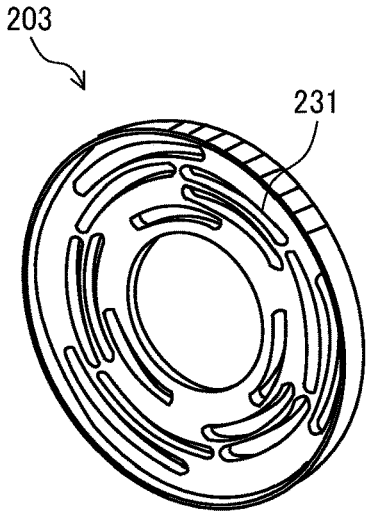
FIGS. 16A and 16B are schematic perspective views of a first member that configures the rotary valve.
Figure 16B:
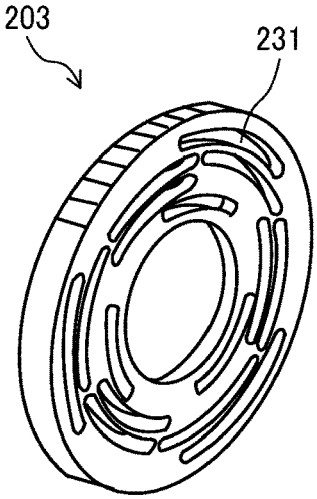

FIGS. 16A and 16B are schematic perspective views of a first member 203 that forms the rotary valve 200.

Figure 17:
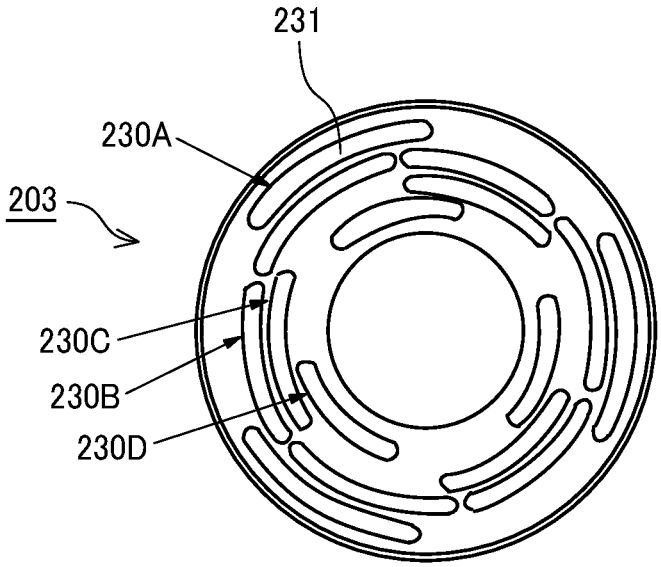
FIG. 17 is a schematic side view of the first member.

FIG. 17 is a schematic side view of the first member 203.

Figure 18A:
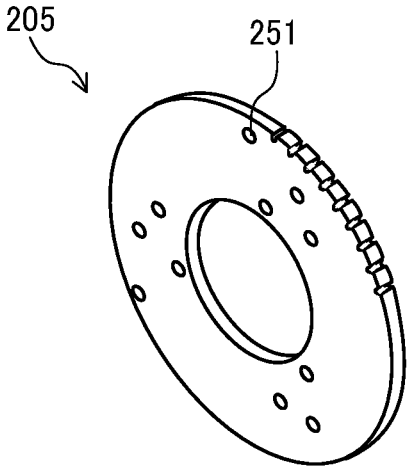
FIGS. 18A and 18B are schematic perspective views of a third member that configures the rotary valve.
Figure 18B:
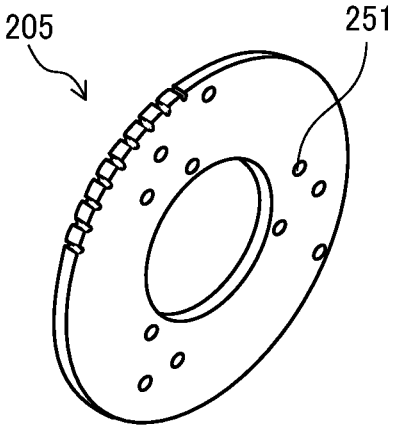

FIGS. 18A and 18B are schematic perspective views of a third member 205 that forms the rotary valve 200.

Figure 19:
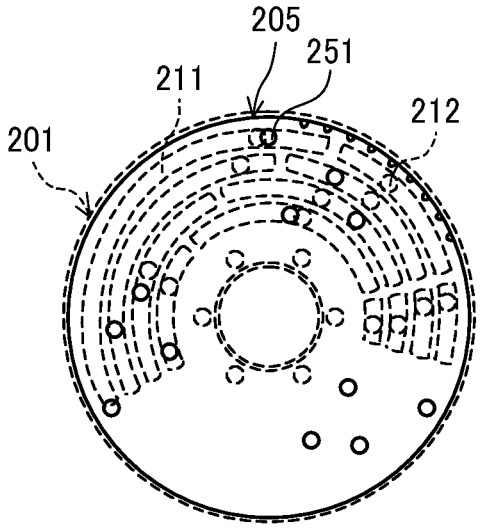
FIG. 19 is a schematic side view of the third member overlaid on the fixing part.

FIG. 19 is a schematic side view of the third member 205 overlaid on the fixing part 201.

As illustrated in FIG. 3, the rotary valve 200 includes the fixing part 201 fixed to a frame 100 of the printer 1. The frame 100 supports the drum 51, the transfer cylinder 24, the discharge unit 23, and the like.

As illustrated in FIGS. 12A and 12B, the fixing part 201 includes rows of a plurality of grooves 211 arranged in a radial direction and divided into three parts in the circumferential direction of the fixing part 201. The rows of the plurality of grooves 211 are formed on a side surface of the fixing part 201 to be slidably fitted to the rotation part 202. Each groove 211 includes a through hole 212 to be connected to the suction device 52. Here, the rows of the grooves 211 positioned on the identical concentric circle are referred to as groove rows 210A, 210B, 210C, and 210D as illustrated in FIG. 13.

The rotation part 202 of the rotary valve 200 includes a first member 203, a second member 204, and a third member 205. The first member 203, the second member 204, and the third member 205 are arranged in an order of the third member 205, the first member 203, and the second member 204 from the fixing part 201 as illustrated in FIG. 10. In the radial direction, the first member 203 has a shape that covers the outer circumferential surface of the third member 205, and the third member 205 fits into the first member 203 as illustrated in FIG. 10.

Each of the first member 203, the second member 204, and the third member 205 is a disk-shaped member. The second member 204 contact with the first member 203 and communicates with the suction holes 112 of the drum 51. The first member 203 is between the second member 204 and the third member 205 and contacts with the second member 204 and the third member 205. The third member 205 is between the first member 203 and the fixing part 201 and contacts with the first member 203 and the fixing part 201. The first member 203 communicates with the suction device 52 via the third member 205 and the fixing part 201.

As illustrated in FIGS. 14A and 14B, and FIG. 15, the second member 204 is a disk-shaped member including a plurality of (here, nine) holes 241 (241A to 241I) communicating with the suction port 111 of the drum 51 on a circumferential surface of the second member 204 (disk-shaped member). Each holes 241 includes an opening 241*a* on a side surface of the second member 204. The side surface of the second member 204 contacts with the first member 203. The nine holes 241A to 241I arranged in the circumferential direction communicate with the nine suction ports 111*a* (111*a*1 to 111*a*9) arranged in the axial direction of the drum 51 and are connectable to the corresponding portions of the plurality of suction holes 112.

Further, the second member 204 includes a plurality of types of holes 242 (242A to 242I) on the side surface of the second member 204 (disk-shaped member) or the like (see FIG. 15). The holes 242 as described above also communicates with the suction ports 111.

Figure 26A:
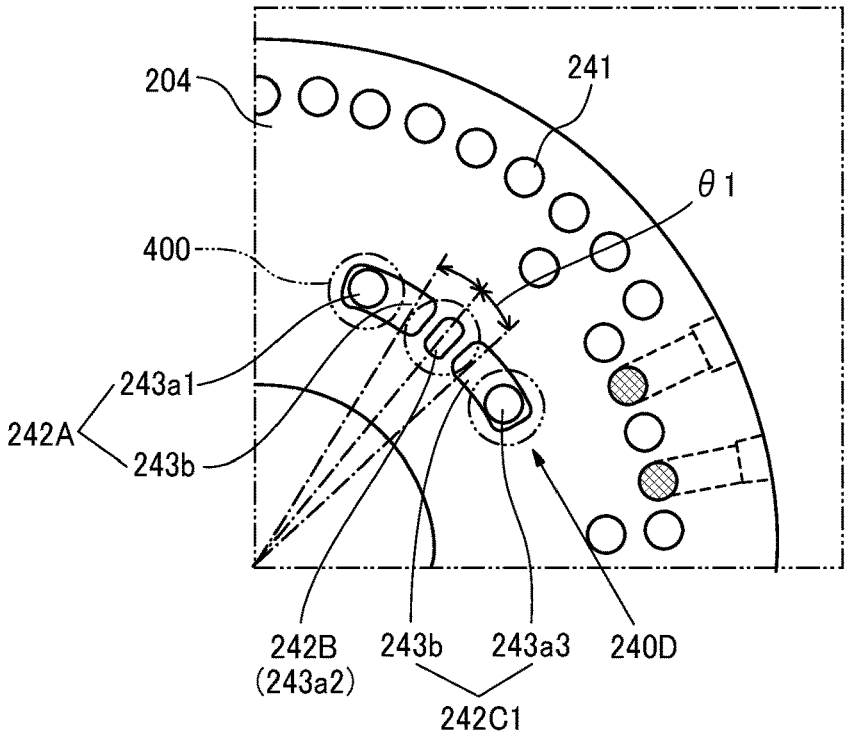
FIGS. 26A and 26B are schematic side views of the second member illustrating a configuration and an effect of a hole on the side surface of the second member.

As illustrated in FIG. 26A, the hole 242A includes a through hole 243*a*1 that penetrates through the second member 204 in the axial direction and a second groove 243*b* extending in the circumferential direction (rotation direction) of the second member 204 and communicating with the through hole 243*a*1.

Similarly, the hole 242C1 includes a through hole 243*a*3 that penetrates through the second member 204 in the axial direction and a second groove 243*b* extending in the circumferential direction (rotation direction) of the second member 204 and communicating with the through hole 243*a*3. That is, at least one hole of the plurality of holes 242 has a groove extending in the circumferential direction.

Each of the holes 242B, 242C2, 242E, 242G1, and 242H includes a through hole 243*a* that penetrates through the second member 204 in the axial direction. Each of the holes 242D, 242F, 242G2, and 242I includes a non-through hole 243*c* that does not penetrate through the second member 204 in the axial direction and a hole 243*d* that extends in the radial direction from the non-through hole 243*c*.

As illustrated in FIG. 15, the pluralities of holes 241 are provided for each of the bearing regions 105A, 105B, and 105C (see FIGS. 4 and 8). However, the holes 241 for one bearing region 105, for example, are simply illustrated in FIG. 14.

The first member 203 is a disk-shaped member that includes through grooves 231 (first grooves) along a circumferential direction on a side surface of the first member 203 (disk-shaped member). The through grooves 231 (first grooves) are provided for each of the bearing regions 105 (105A, 105B, and 105C, see FIGS. 4 and 8). Hereinafter, the through groove 231 is also referred to as the "first groove 231".

As illustrated in FIG. 17, the first member 203 includes the through grooves 231 (230A, 230B, 230C, and 230D) at four positions that are concentric in the radial direction from the outer circumferential side toward the center of the first member 203. Each row of the through grooves 231 (first grooves) positioned at the same concentric circle is collectively referred to as the groove rows 230A, 230B, 230C, and 230D, respectively.

With reference again to FIG. 15, rows of the holes 241 and the holes 242 of the second member 204 corresponding to the groove rows 230A to 230D of the first member 203 are respectively referred to as hole rows 240 (240A to 240D) from the outer circumference side toward the center (innermost) of the second member 204. Each of the row of the holes 241 and the holes 242 is arranged in the circumferential direction of the second member 204.

The second member 204 includes the holes 242C1 and 242C2. The holes 242C1 and 242C2 are two or more holes 242 that are simultaneously communicate with the first groove 231 of the groove row 230D and the first groove 231 of the groove row 230B of the first member 203, respectively, by a rotation of the first member 203 for a unit rotation amount. The hole 242C1 belongs to the hole row 240D, and the hole 242C2 belongs to the hole row 240B.

Thus, the holes 242C1 and 242C2 are the two or more holes 242 that simultaneously communicate with the groove row 230D and the groove row 230B, respectively. The holes 242C1 and 242C2 are disposed at different distances from a rotation center "O" of the second member 204 (see FIG. 15). In other words, the two holes 242C1 and 242C2 simultaneously communicate with the groove row 230D and the groove row 230B, respectively. The two holes 242C1 and 242C2 respectively belong to the different hole rows 240D and 240B among the plurality of hole rows 240 arranged in the radial direction of the second member 204.

Similarly, the second member 204 includes the hole 242G1 and 242G2. The holes 242G1 and 242G2 are two or more holes 242 that simultaneously communicate with the first groove 231 of the groove row 230B and the first groove 231 of the groove row 230C of the first member 203, respectively, by the rotation of first member 203 for the unit rotation amount. The hole 242G1 belongs to the hole row 240B, and the hole 242G2 belongs to the hole row 240C of the second member 204.

That is, the holes 242G1 and 242G2 are the two or more holes 242 that simultaneously communicate with the groove row 230B and the groove row 230C of the first member 203, respectively. The holes 242G1 and 242G2 are disposed at different distances from the rotation center O of the second member 204. In other words, the two holes 242G1 and 242G2 simultaneously communicate with the groove row 230B and the groove row 230C of the first member 203, respectively. The two holes 242G1 and 242G2 respectively belong to the different hole rows 240B and 240C among the plurality of hole rows 240 arranged in the radial direction of the second member 204.

Thus, the second member 204 includes the two holes 242C1 and 242C2 or the two holes 242G1 and 242G2 that that simultaneously communicate with the groove row 230B and the groove row 230C of the first member 203, respectively. Thus, the rotary valve 200 can selects one of the two holes 242C1 and 242C2 or selects one of the two holes 242G1 and 242G2 according to a size of the sheet P to be used. The rotary valve 200 closes one of unselected two holes 242C1 and 242C2 or closes one of unselected two holes 242G1 and 242G2 by a plug. Thus, the rotary valve 200 can easily change the suction region according to a type of a size of the sheet P (destination of the sheet P).

As illustrated in FIGS. 10, 18A and 18B, and 19, the third member 205 is a disk-shaped member that includes a through hole 251 through which the grooves 211 of the fixing part 201 and the through grooves 231 (first grooves) of the first member 203 (see FIGS. 16A and 16B) communicate with each other (see FIG. 10). The through hole 251 penetrate through the third member 205 (disk-shaped member).

The first member 203, the second member 204, and the third member 205 form the rotation part 202. The first member 203, the second member 204, and the third member 205 rotate along with a rotation of the drum 51 when the sheet P is conveyed.

When the rotary valve 200 changes (switches) the suction region (suction area), the rotary valve 200 rotates the first member 203 relative to the second member 204 and the third member 205. The second member 204 rotates together with the third member 205. Rotation of the first member 203 changes a number of holes 242 of the second member 204 communicating with the first grooves 231 of the first member 203. Thus, a connection status of a suction channel in the rotary valve 200 changes. Thus, the rotary valve 200 can change (switch) the suction region (suction area) according to the size of the sheet P (destination of the sheet P).

Next, an allocation of the bearing regions 105 and the grooves is described with reference to FIG. 20.

Figure 20:
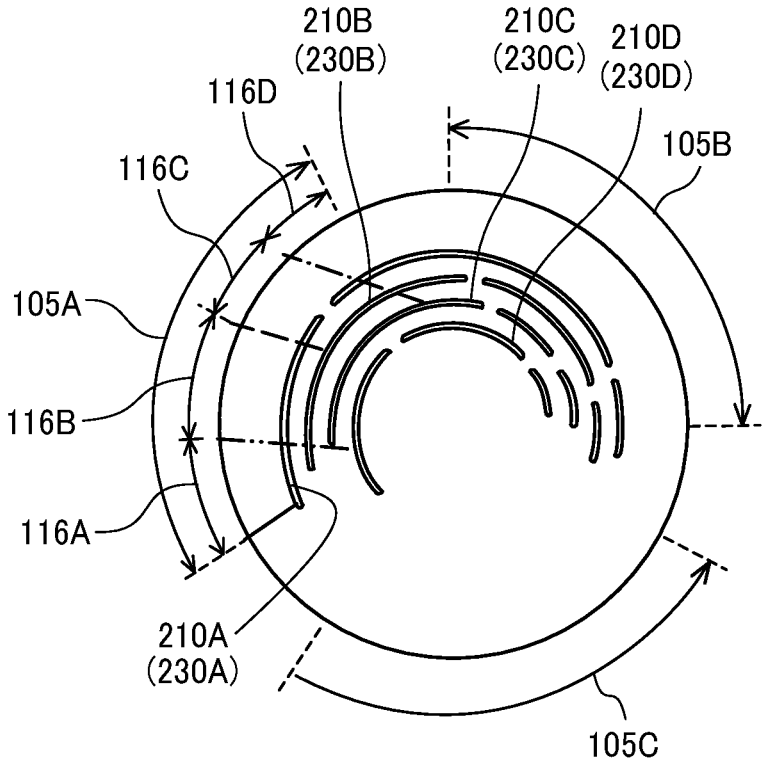
FIG. 20 is a schematic side view of the drum illustrating an allocation of the bearing region and grooves of the fixing part.

FIG. 20 is a side view of the drum 51 illustrating the allocation of the bearing regions 105 and the grooves.

As described above, the circumferential surface of the drum 51 is divided into three bearing regions 105 (105A to 105C). One bearing region 105 is divided into four regions of the first region 116A to the fourth region 116D.

The outermost groove row 210A of the fixing part 201 is allocated to the first region 116A. The groove row 230A of the first member 203 switches between communication and noncommunication of each suction port 111 of the first region 116A with the suction device 52. That is, the groove row 230A connects and disconnects each suction port 111 of the of the first region 116A with the suction device 52.

Further, the groove row 210D other than the first region 116A is allocated to the second region 116B. The groove row 230D of the first member 203 switches between communication and noncommunication of each suction port 111 of the second region 116B with the suction device 52. That is, the groove row 230D connects and disconnects each suction port 111 of the second region 116B with the suction device 52. Similarly, the groove row 210B of the fixing part 201 is allocated to the third region 116C.

The groove row 230B of the first member 203 switches between communication and noncommunication of each suction port 111 of the third region 116C with the suction device 52. That is, the groove row 230B connects and disconnects each suction port 111 of the third region 116C with the suction device 52. Similarly, the groove row 210C of the fixing part 201 is allocated to the fourth region 116D.

The groove row 230C of the first member 203 switches between communication and noncommunication of each suction port 111 of the fourth region 116D with the suction device 52. That is, the groove row 230C connects and disconnects each suction port 111 of the fourth region 116D with the suction device 52.

Next, a switching operation (size switching operation) of the suction regions (suction areas) by relative rotation of the first member 203 and the second member 204 is described with reference to FIGS. 21A to 21C and FIGS. 22A to 22C.

FIGS. 21A to 22C illustrate the switching operation (size switching operation) of the suction regions by the relative rotation of the first member 203 and the second member 204.

Figure 21A:
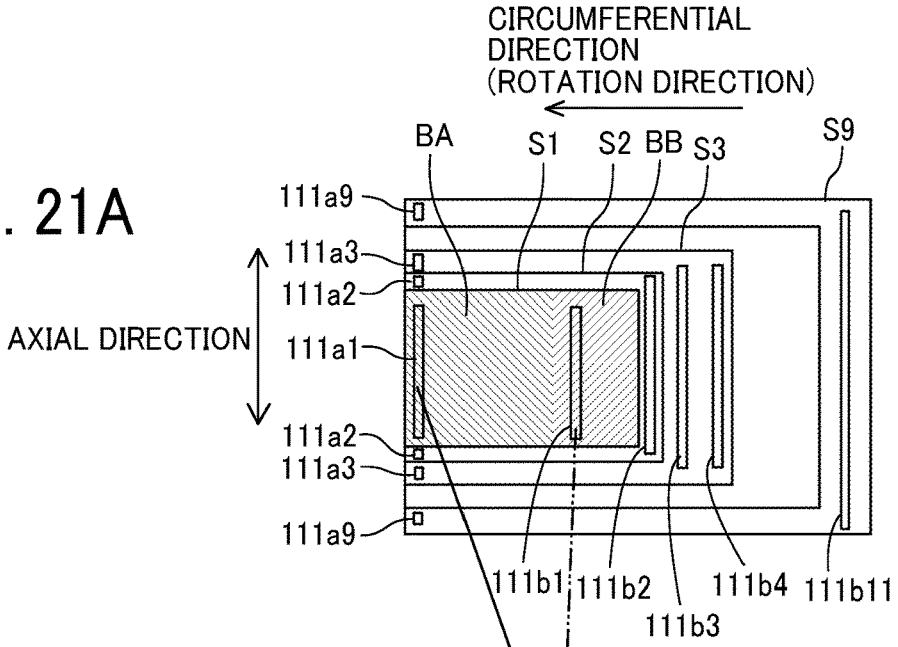
FIGS. 21A to 21C are schematic plan view and side views of the rotary valve illustrating changing of suction regions (size changing) by relative rotation of the first member and the second member.
Figure 22A:
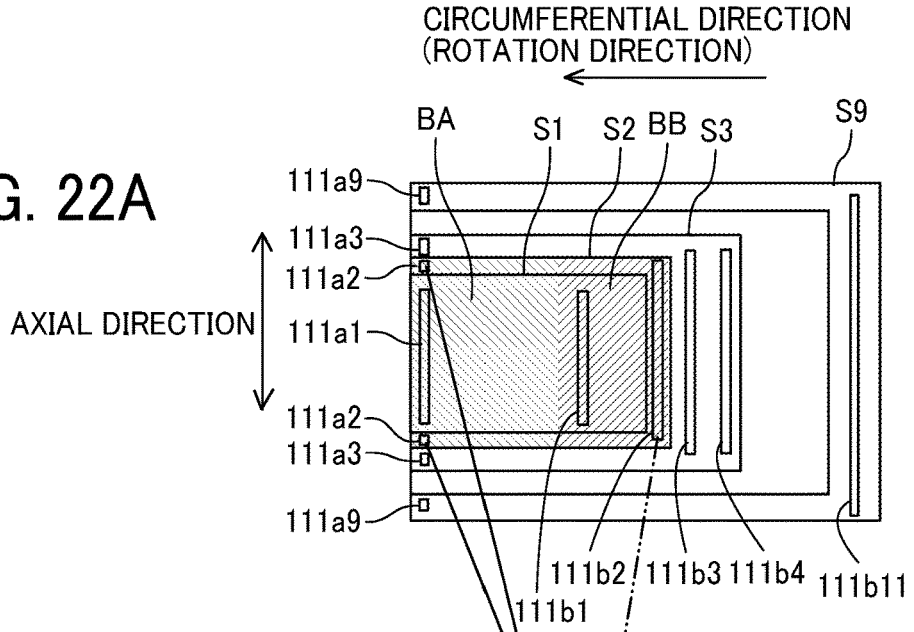
FIGS. 22A to 22C are schematic plan view and side views of the rotary valve illustrating changing of the suction regions (size changing)

FIGS. 21A and 22A are schematic plan views of the drum 51 illustrating the size of the sheet P and the suction ports 111 on the drum 51.

Figure 21B:
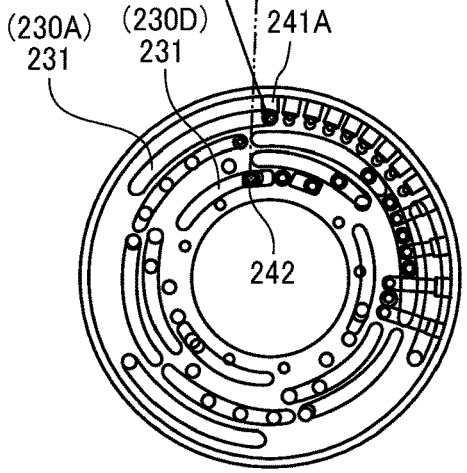
Figure 22B:
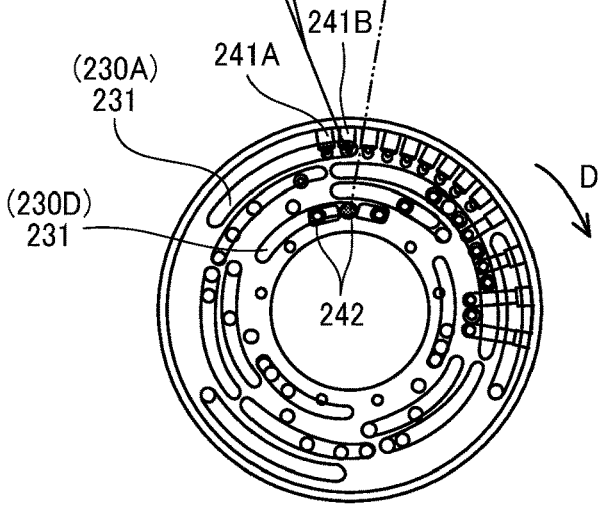

FIGS. 21B and 22B are schematic transparent side views of the first member 203 and the second member 204.

Figure 21C:
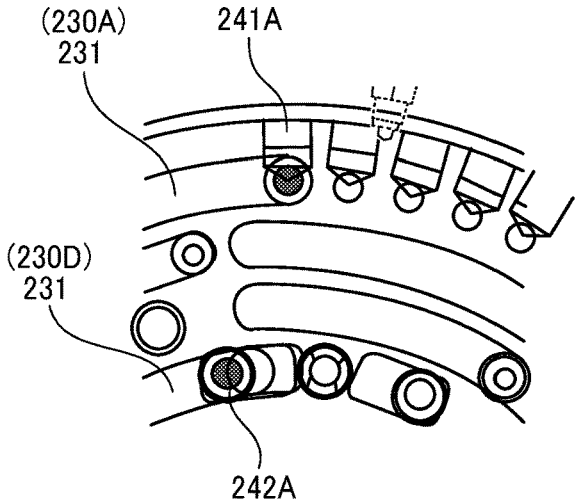
Figure 22C:
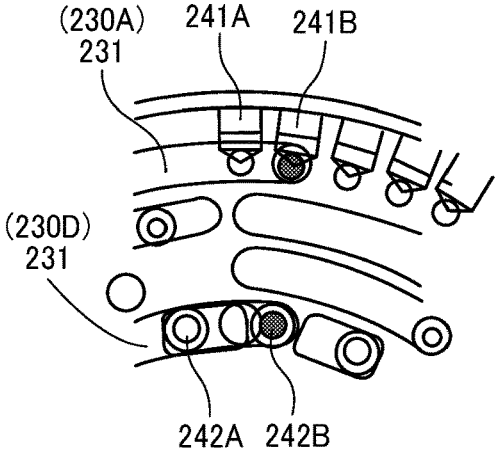

FIGS. 21C and 22C are enlarged transparent side views of the first member 203 and the second member 204 in FIGS. 21B and 22B.

As described above, the nine holes 241A to 241I (see FIG. 15) in the circumferential direction of the second member 204 communicate with the nine suction ports 111*a* (111*a*1 to 111*a*9) of the drum 51.

Therefore, switching (changing) of a number of holes 241 of the second member 204 (thus a number of suction ports 111*a* of the drum 51) communicating with the first groove 231*a* of the groove row 230A of the first member 203 switches (changes) the size of the suction region (suction area) in the axial direction of the drum 51. The axial direction of the drum 51 is perpendicular to the circumferential direction of the drum 51 (see FIGS. 21A and 22A).

That is, switching (changing) of the number of holes 241 of the second member 204 (number of suction ports 111*a* of the drum 51) communicating with the first grooves 231 of the first member 203 switches (changes) the number of the suction holes 112 facing the chamber 113 with which the suction ports 111*a* of the drum 51 communicate.

Further, the holes 242 of the second member 204 (suction ports 111*b* (111*b*1 to 111*b*11) of the drum 51) communicate with one of the groove rows 230B to 230D of the first member 203.

Therefore, switching (changing) of a number of suction ports 111*b* (111*b*1 to 111*b*11) of the drum 51 communicating with the first groove 231 of the groove rows 230B to 230D of the first member 203 via the holes 242 of the second member 204 switches (changes) the size of the suction region (suction area) in the circumferential direction of the drum 51.

That is, switching (changing) of the number of holes 242 of the second member 204 (number of suction ports 111*b* of the drum 51) communicating with the first grooves 231 of the first member 203 switches (changes) the number of the suction holes 112 facing the chamber 113 with which the suction ports 111*b* of the drum 51 communicate.

For example, as illustrated in FIGS. 21B and 21C, the relative positional relation between the first member 203 and the second member 204 is set to a state in which the first groove 231 of the groove row 230A of the first member 203 communicates with the hole 241A of the second member 204, and the first groove 231 of the groove row 230D of the first member 203 communicates with the hole 242 of the second member 204.

Thus, the suction device 52 communicates with the suction port 111*a*1 of the drum 51. Further, the suction device 52 communicates with the suction ports 111*b*1 of the drum 51.

Thus, as illustrated in FIG. 21A, the suction device 52 sucks air through the suction holes 112 (see FIGS. 3 and 4) belonging to a region BA communicating with the suction port 111*a*1 and a region BB communicating with the suction port 111*b*1 so that the suction device 52 can suck the air in the suction region of the sheet region S1.

From the state as illustrated in FIG. 21A, the first member 203 is rotated in a direction indicated by arrow "D" (hereinafter referred to as "direction D") with respect to the second member 204 as illustrated in FIGS. 22B and 22C. The direction D is a clockwise direction in FIGS. 22B and 22C.

Thus, the relative positional relation between the first member 203 and the second member 204 becomes a state in which the first groove 231 of the groove row 230A of the first member 203 communicates with the two holes 241A and 241B of the second member 204, and the first groove 231 of the groove row 230D of the first member 203 communicates with the two holes 242 of the second member 204 Note that shaded circles in FIGS. 22B and 22C indicate the holes 241 and 242 (i.e. the hole 241B and 242) that are new holes 241 and 242 of the second member 204 communicating with the first groove 231 of the first member 203.

Then, the suction device 52 communicates with the suction ports 111*a*1 and 111*a*2 of the drum 51. Further, the suction device 52 communicates with the suction ports 111*b*1 and 111*b*2 of the drum 51.

Thus, as illustrated in FIG. 22A, the suction device 52 sucks air through the suction holes 112 belonging to a region BA communicating with the suction port 111*a*1 and 111*a*2 and a region BB communicating with the suction port 111*b*1 and 111*b*2 so that the suction device 52 can suck the air in the suction region of the sheet region S2 having an area larger than the sheet region S1.

FIGS. 23A to 23C, FIGS. 24A to 24C, and FIGS. 25A to 25C illustrate transition of the relative positions between the first member 203 and the second member 204 when the first member 203 is rotated to change the relative positions in nine rotation steps (nine rotation phases) in the above-described configuration of the rotary valve 200.

FIGS. 23A to 23C, FIGS. 24A to 24C, and FIGS. 25A to 25C are schematic transparent side views of the first member 203 and the second member 204.

Figure 23C:
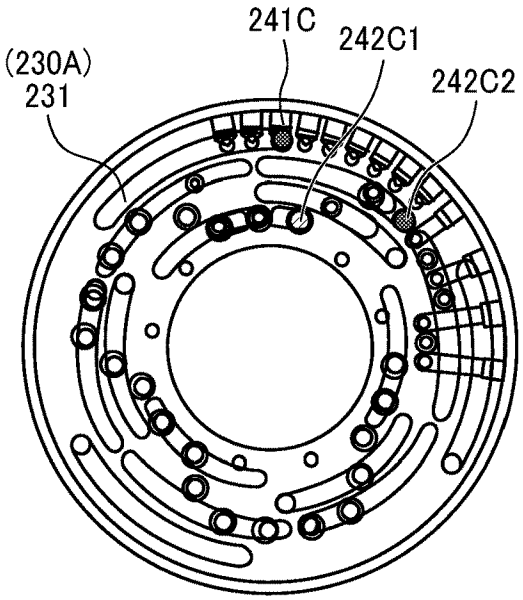
FIGS. 23A to 23C are schematic transparent side views of the first member and the second member in a transition state of a relative positions between the first member and the second member when the relative positions are changed in nine steps.
Figure 23B:
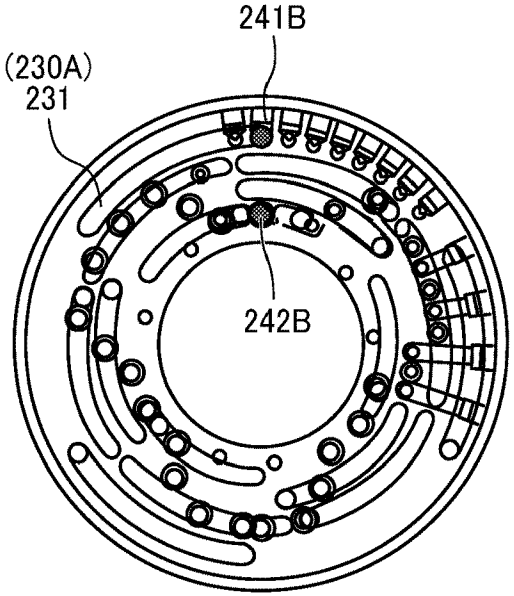
Figure 23A:
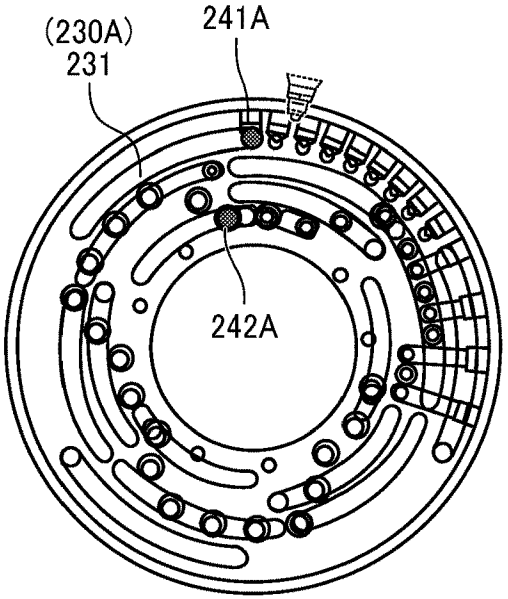
Figure 24A:
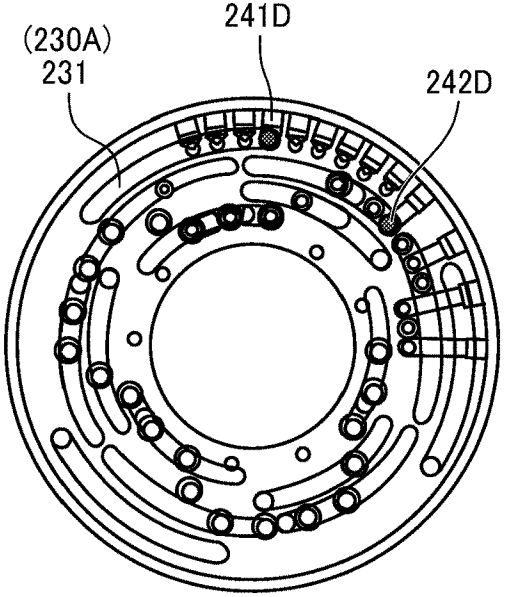
FIGS. 24A to 24C are schematic transparent side views of the first member and the second member illustrating the transition state following the transition state in FIG. 23A to 23C.
Figure 24B:
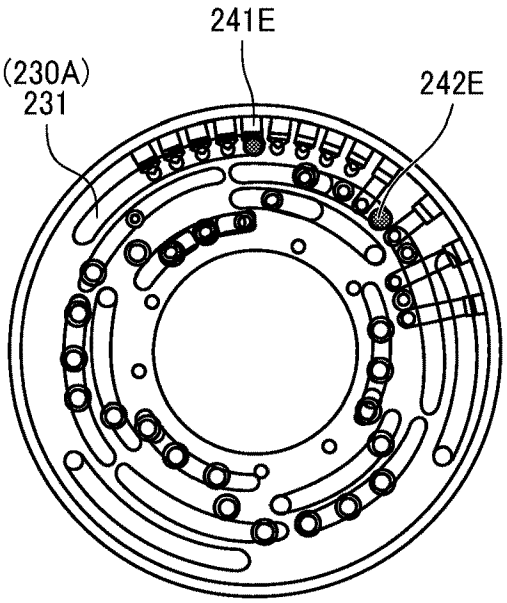
Figure 24C:
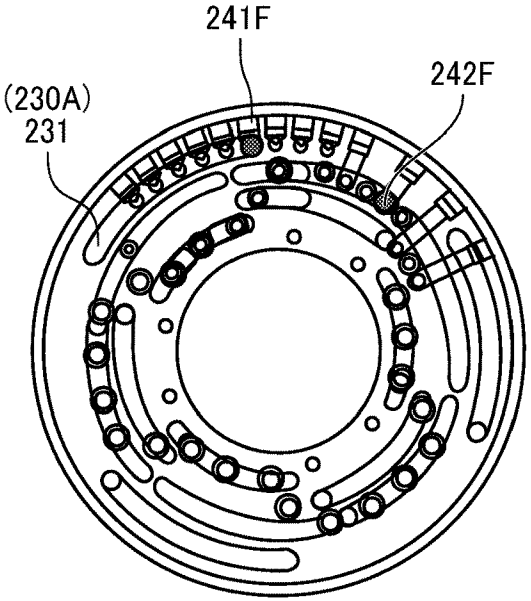
Figure 25A:
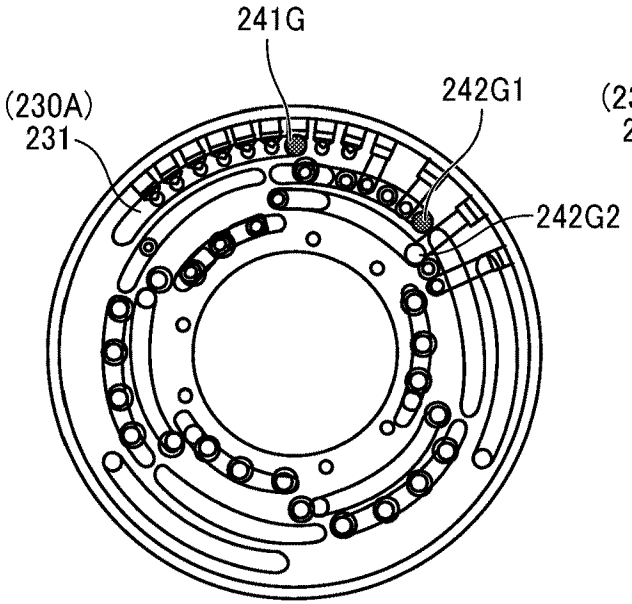
FIGS. 25A to 25C are schematic transparent side views of the first member and the second member illustrating the transition state following the transition state in FIG. 24A to 24C.
Figure 25B:
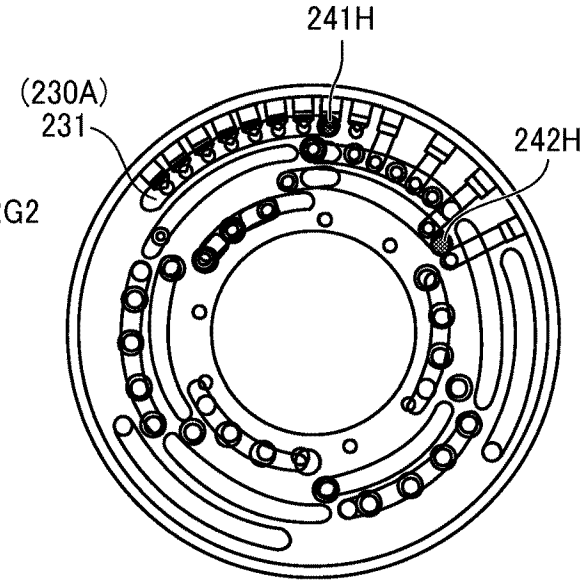
Figure 25C:
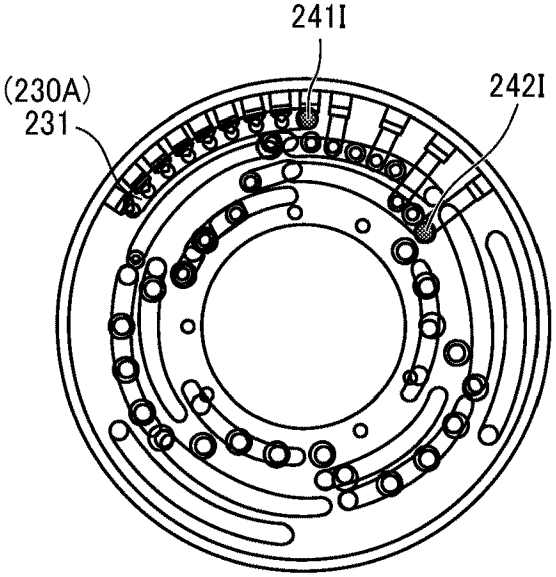

Note that FIG. 23A is the same position as FIG. 21B, and FIG. 23B is the same position as FIG. 22B.

The holes 241 and 242 of the second member 204 are arranged so that the two or three holes 241 and 242 communicate with one of the bearing regions 105 of the drum 51 for each time the relative position is switched (changed) by one rotation step (one rotation phase). The rotary valve 200 according to the first embodiment includes the drum 51 having three bearing regions 105 (105A to 105C, see FIG. 4). Thus, a number of the holes 241 and 242 of the second member 204 communicate with the bearing regions 105 by one rotation step (one rotation phase) of the first member 203 becomes six or nine.

The number of holes 241 and 242 are set to two or three for one rotation step (one rotation phase) so that the sheet suction device 50 can select the suction regions according to the destination of the sheet P. For example, three suction ports 111*b* of the drum 51 may be allocated to an innermost groove row 230D of the first member 203 via the holes 241 and 242 of the second member 204, and five suction ports 111*b* of the drum 51 may be allocated to the groove row 230C of the first member 203 via the holes 241 and 242 of the second member 204.

Further, two suction ports 111*b* of the drum 51 may be allocated to the innermost groove row 230D of the first member 203 via the holes 241 and 242 of the second member 204, and five suction ports 111*b* of the drum 51 may be allocated to the groove row 230C of the first member 203 via the holes 241 and 242 of the second member 204.

Next, a configuration and an effect of the holes 241 and 242 of the second member 204 is described with reference to FIGS. 26A and 26B to 28A and 28B.

Figure 26B:
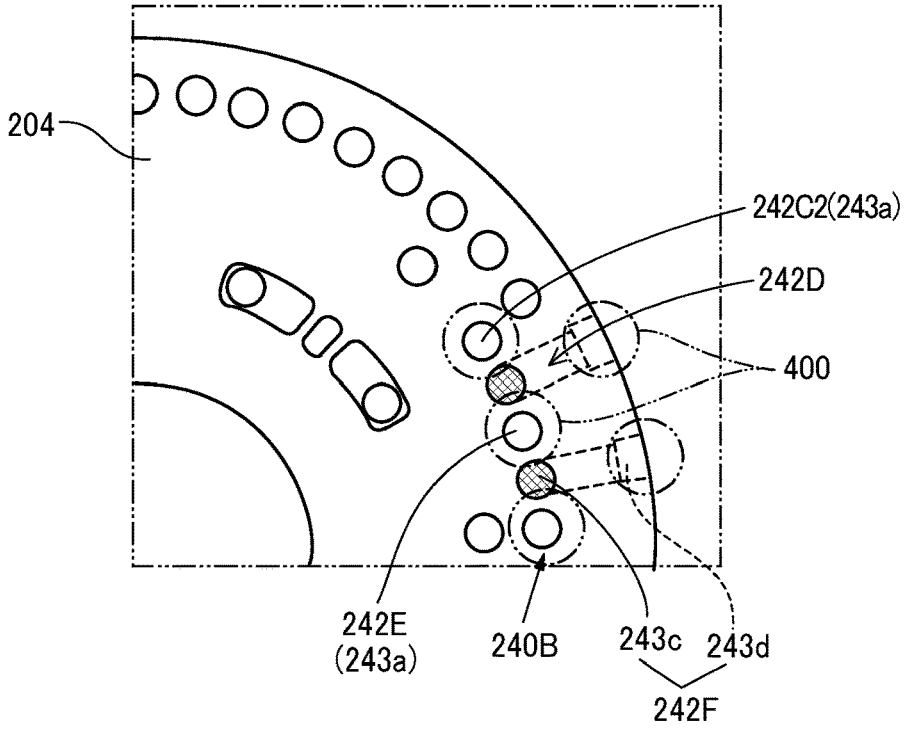

FIGS. 26A and 26B are portions of enlarged schematic side views of the second member 204 illustrating the configuration and the effect of the holes 241 and 242 of the second member 204.

Figure 27:
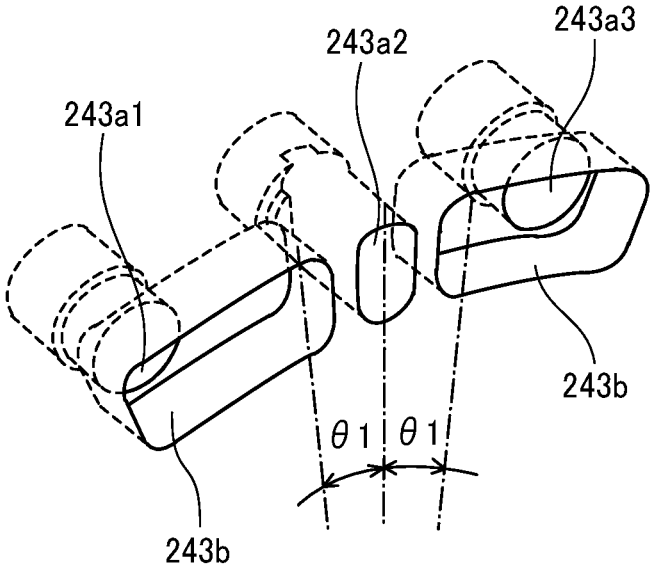
FIG. 27 is an enlarged schematic perspective view of a main part of the second member 204 of FIGS. 26A and 26B.

FIG. 27 is a schematic enlarged perspective view of a portion of the second member 204 of FIGS. 26A and 26B.

Figure 28A:
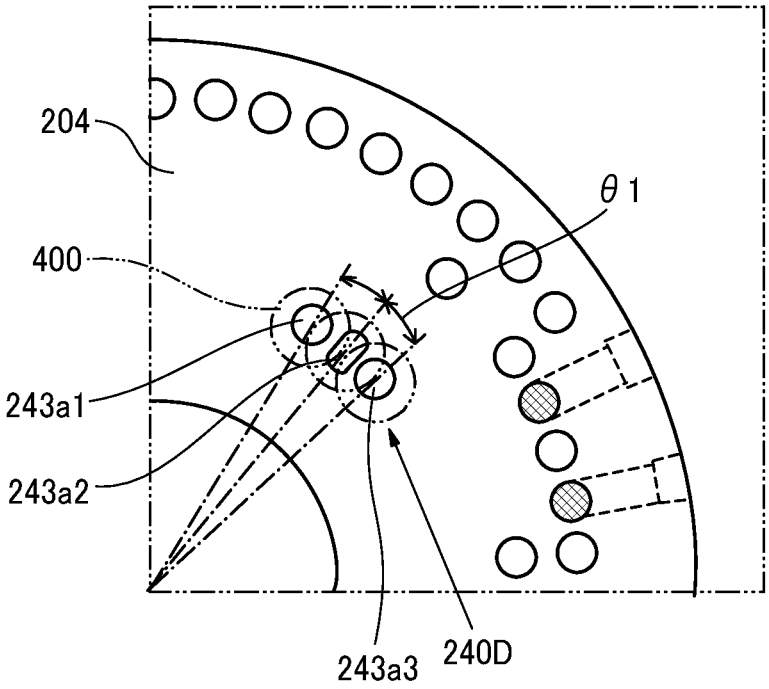
FIGS. 28A and 28B are enlarged schematic side views of a second member according to a comparative example 1.
Figure 28B:
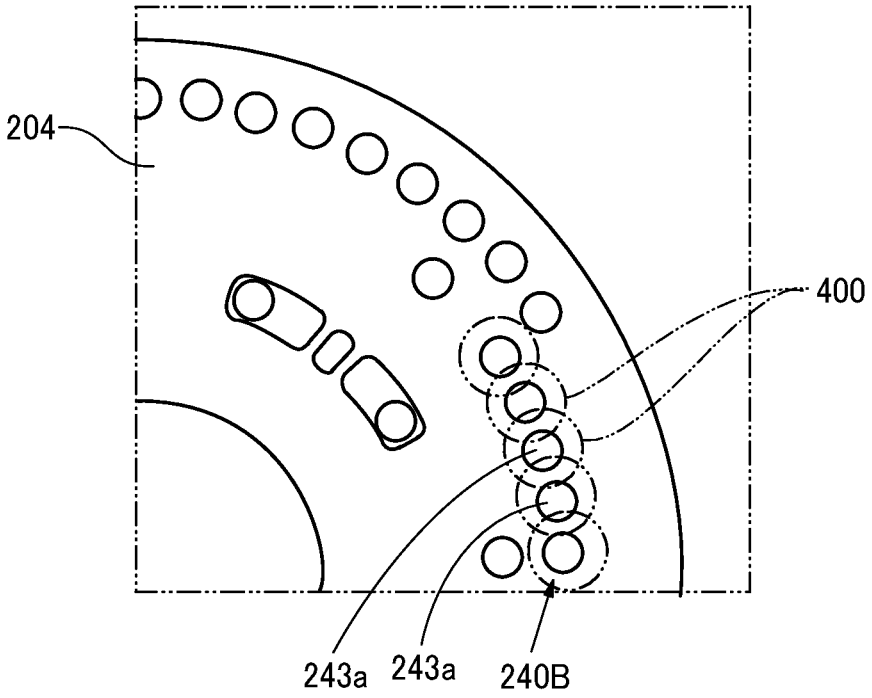

FIGS. 28A and 28B are enlarged schematic side views of a comparative example 1 of the second member 204.

When the suction region (suction area) of the drum 51 is divided into four regions of the first region 116A to the fourth region 116D in the circumferential direction (rotation direction) as illustrated in FIG. 6, the first member 203 includes the groove rows 230A to 230D arranged in four rows in the radial direction.

That is, the holes 242 of the second member 204 are respectively connected with the hoses (tubes) via connectors 400 so that the connectors 400 and hoses (tubes) are densely packed. Further, a length and a position of the first groove 231 of the groove row 230A to 230D of the first member 203 in the circumferential direction are limited so that the suction region (suction area) can be divided into the first region 116A to the fourth region 116D.

Further, as described above, the row of the innermost (center side) holes 242 of the second member 204 corresponding to the innermost (center side) groove row 230D of the first member 203 is referred to as the hole row 240D (see FIG. 26A). The through holes 243*a* of the three holes 242A, 242B, and 242C1 arranged in the circumferential direction of the hole row 240D are respectively referred to as through holes 243*a*1, 243*a*2, and 243*a*3.

To provide (connect) the connector 400 to each of the through holes 243*a*1, 243*a*2, and 243*a*3 of the second member 204, the through holes 243*a*1 and 243*a*3 on both sides of the hole 243*a*2 has to be arranged at intervals at which the connector 400 can be arranged with respect to the central through hole 243*a*2.

The second member 204 in the comparative example 1 as illustrated in FIG. 28A includes the holes 242A, 242B, and 242C1 of the hole row 240D that includes only the through holes 243*a*1, 243*a*2, and 243*a*3.

Thus, the connectors 400 attached to the through holes 243*a*1, 243*a*2, and 243*a*3 interfere with each other in the comparative example 1 illustrated in FIG. 28A when a diameter of the second member 204 becomes smaller. Thus, a minimum radius of the second member 204 in the comparative example 1 depends on a size of the connector 400. Thus, it is difficult to reduce a diameter of the second member 204 in the comparative example 1.

Conversely, the second member 204 according to the first embodiment includes the through hole 243*a*2 as the hole 242B in a center in the innermost hole row 240D of the second member 204 as illustrated in FIG. 26A. Each of the hole 242A and 242C1 on both sides of the hole 242B in the hole row 240D includes a second groove 243*b* arranged along the circumferential direction of the second member 204.

As illustrated in FIG. 26A, the through holes 243*a*1 of the hole 242A is formed in an area of the second groove 243*b* of the hole 242A so that the through hole 243*a*1 communicates with the second groove 243*b* of the hole 242A. The through holes 243*a*3 of the hole 242C1 is formed in an area of the second groove 243*b* of the hole 242C1 so that the through hole 243*a*3 communicates with the second groove 243*b* of the hole 242C1.

Thus, the second member 204 includes a plurality of hole rows 240 (four hole rows 240A to 240D in FIG. 15) in a radial direction of the second member 204. Each of the plurality of hole rows 240 includes the plurality of holes 242 arranged in the row in the circumferential direction of the second member 204. The second groove 243*b* communicates with at least one of the plurality of holes 242 of the innermost hole row 240D in the plurality of hole rows 240 in the radial direction of the second member 204.

Thus, the first member 203 includes the first groove 231 on a side surface in a circumferential direction of the first member 203. The first groove 231 communicates with the suction device 52. The second member 204 includes a plurality of holes 243*a*1, 243*a*2, and 243*a*3 on one side surface arranged in a row in a circumferential direction of the second member 204. The plurality of holes 243*a*1, 243*a*2, and 243*a*3 communicating with the plurality of suction holes 112. The second member 204 further includes a second groove 243*b* on another side surface in the circumferential direction of the second member 204. The second groove 243*b* communicates with at least one of the plurality of holes 243*a*1, 243*a*2, and 243*a*3 of the second member 204.

Thus, the second member 204 can displace each of the position of the through holes 243*a*1 and 243*a*3 away from the through hole 243*a*2 of the hole 242B in the center of the hole row 240D in the circumferential direction in the second member 204. Therefore, the through holes 243*a*1, 243*a*2, and 243*a*3 can be arranged at intervals so that the connectors 400 of the through holes 243*a*1, 243*a*2, and 243*a*3 do not interfere with each other. Thus, the second member 204 in the first embodiment can reduce a size of the second member 204 and a size of the printer 1.

As illustrated in FIGS. 26A and 27, to change a number of connection channels, the hole 242A, the hole 242B, and the hole 242C1 are arranged in this order in the direction D (see FIG. 22B) to be sequentially connected to the groove rows 230D (see FIG. 22C) of the first member 203 in the order of the hole 242A, the hole 242B, and the hole 242C1 according to a stepwise rotation of the first member 203 in the direction D with a pitch θ1. The hole 243*a*1 and the groove 243*b* connected to the hole 243*a*1 forms the hole 242A. The hole 243*a*2 forms the hole 242B. The hole 243*a*3 and the groove 243*b* connected to the hole 243*a*3 forms the hole 242C1.

Each one end of two second grooves 243*b* is adjacent (close) to the through hole 243*a*2 with the interval of the pitch θ1. Another end of two second grooves 243*b* communicate with the through hole 243*a*1 and 243*a*3, respectively.

Thus, one of an end of the second groove 243*b* is connected to one of the plurality of holes 243*a*1 and 243*a*3, and another end of the second groove 243*b* is adjacent to another of the plurality of holes 243*a*2 adjacent to said one of the plurality of holes 243*a*1 and 243*a*3.

In the comparative example 1 as illustrated in FIG. 28B, the hole 242 of the hole row 240B includes through holes 243*a*. However, the second member 204 in a configuration of the comparative example 1 has to increase a size of the second member 204 since the connectors 400 connected to the through holes 243*a*3 interfere with each other.

Thus, as illustrated in FIG. 26B, the second member 204 according to the first embodiment includes holes 242C2 and 242E of the through hole 243*a* and holes 242D and 242F of the non-through holes 243*c* and 243*d*.

FIG. 26B illustrates the holes 242C2 to 242F as the hole 242 of the hole row 240B. The holes 242C2 and 242E of the through hole 243*a* and the holes 242D and 242F of the non-through hole 243*c* and 243*d* are alternately arranged. The hole 243*d* is connected the non-through holes 243*c*, and the hole 243*d* is arranged outside the non-through hole 243*c* in the radial direction of the second member 204.

Thus, the connector 400 can be attached to the through holes 243*a*1, 243*a*2, and 243*a*3 even when the holes 242 are densely arranged. Thus, the second member 204 in the first embodiment can reduce a size of the second member 204 and a size of the printer 1.

Next, a switching operation of the first member 203 is described with reference to FIGS. 29 to 32.

Figure 29:
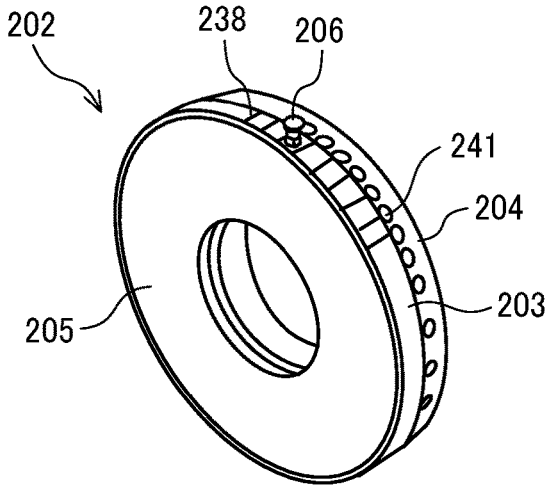
FIG. 29 is a schematic perspective view of a rotating part of the rotary valve illustrating a changing operation of the first member.

FIG. 29 is a schematic perspective view of the rotation part 202 of the rotary valve 200.

Figure 30:
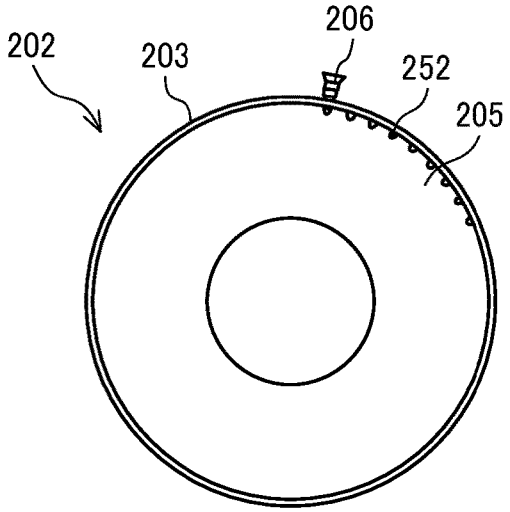
FIG. 30 is a schematic side view of the rotating part of the rotary valve.

FIG. 30 is a schematic side view of the rotary valve 200 of FIG. 29.

Figure 31:
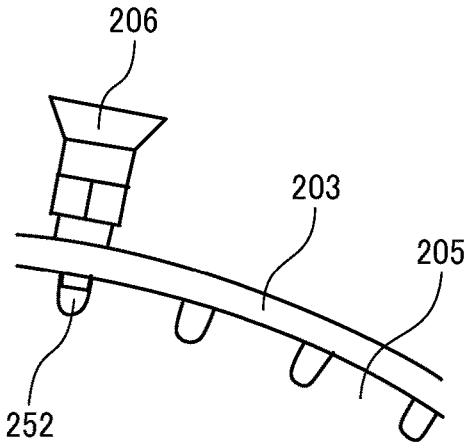
FIG. 31 is an enlarged side view of a main part of the rotating part.

FIG. 31 is an enlarged schematic side view of a main part of the rotation part 202 of the rotary valve 200.

Figure 32:
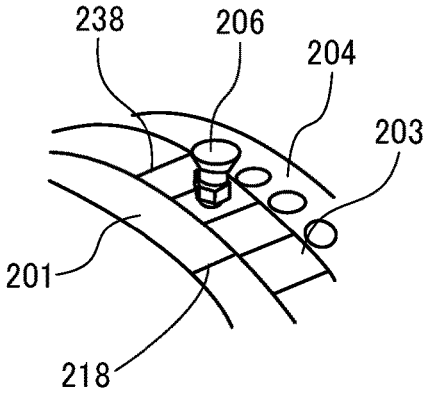
FIG. 32 is an enlarged perspective view of a main part of the rotating part.

FIG. 32 is an enlarged schematic perspective view of a main part of the rotation part 202 of the rotary valve 200.

The first member 203 of the rotary valve 200 according to the second embodiment is manually rotatable by the user. Thus, the first member 203 is manually rotated by the user to switch the suction regions. An index plunger 206 is used to rotate the first member 203. A rotation operation of the first member 203 is also referred to as a "suction region changing (switching) operation." A leading end of the index plunger 206 is fitted into one of holes 252 formed on a circumferential surface of the third member 205 according to each position of the suction region (suction area) to determine the position of the suction region.

To rotate the first member 203, the user pulls out the index plunger 206 from the hole 252 and rotates the first member 203 relative to the second member 204 and the third member 205 to a target position. Then, the user inserts the leading end of the index plunger 206 into the hole 252 at the target position.

A scale 238 having nine steps, for example, is formed on the circumferential surface of the first member 203 to indicate a rotation position of the first member 203 so that the user can recognize a setting state of the first member 203.

Further, as illustrated in FIG. 32, a scale 218 as a reference for the scale 238 of the first member 203 may be formed on a circumferential surface of the fixing part 201.

Further, the drum 51 is fixed at a predetermined phase (predetermined position) to change the suction region such as a "sheet size changing mode", for example, so that the user can access the index plunger 206. Further, the drum 51 is fixed at the predetermined phase (predetermined position) so that the drum 51 is not rotated by an operational force of the user operating the index plunger 206.

Next, acquisition of size information of the suction region (suction area) is described with reference to FIG. 33.

Figure 33:
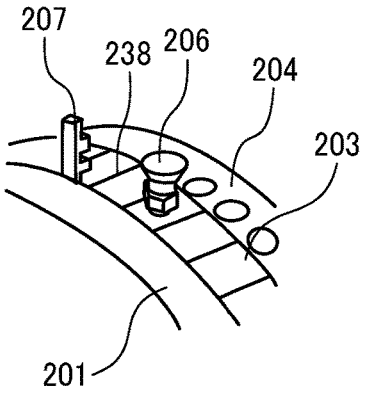
FIG. 33 is an enlarged perspective view of a main part of the rotary valve illustrating acquisition of size information in the suction region.

FIG. 33 is a schematic enlarged perspective view of a main part of the rotary valve 200 illustrating the acquisition of the size information of the suction region (suction area).

Here, a photo sensor 207 is attached to the fixing part 201 that does not rotate together with the drum 51. The first member 203 includes a detection piece (feeler) detectable by the photo sensor 207. Such a configuration of the rotary valve 200 including the photo sensor 207 can detect the detection piece (feeler) by the photo sensor 207 for each one rotation of the drum 51 with a rotation of the first member 203 rotating together with the drum 51. The photo sensor 207 detects the feeler and generates one pulse for each one rotation of the drum 51.

The drum 51 may include a similar mechanism of the photo sensor 207 and the feeler. Thus, the rotary valve 200 can detect one pulse from the feeler on the drum 51 and detect another one pulse from the feeler on the first member 203 during one rotation of the drum 51 so that the rotary valve 200 can obtain a total of two pulses from two systems (drum 51 and first member 203) during one rotation of the drum 51.

The first member 203 has a phase difference with the second member 204 that rotates together with the drum 51. Thus, intervals between the pulses generated from each of the drum 51 rotating at a constant speed and the first member 203 are measured to detect a rotation angle of the first member 203. Thus, the relative phase difference, that is, the setting information of the suction region can be acquired.

Next, a second embodiment of the present disclosure is described with reference to FIGS. 34 to 38.

Figure 34:
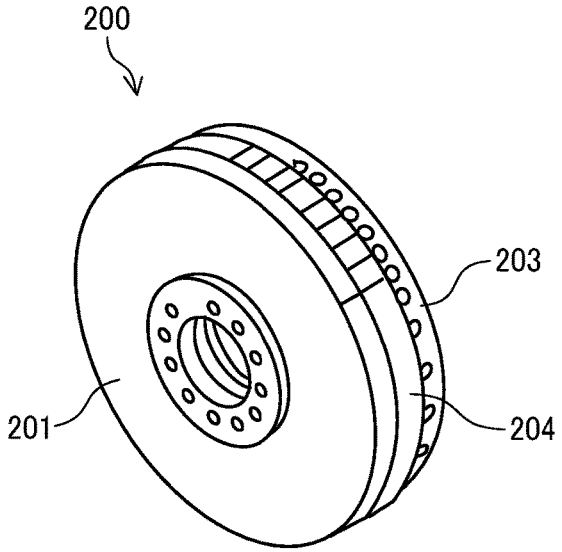
FIG. 34 is an external perspective view of a rotary valve according to a second embodiment of the present disclosure.

FIG. 34 is a schematic external perspective view of the rotary valve 200.

Figure 35:
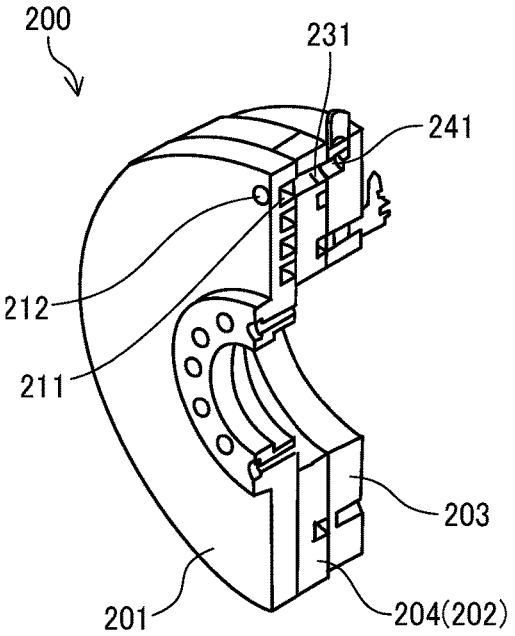
FIG. 35 is a schematic cross-sectional perspective view of the rotary valve cut in half.

FIG. 35 is a cross-sectional perspective view of the rotary valve 200 cut in half.

Figure 36:
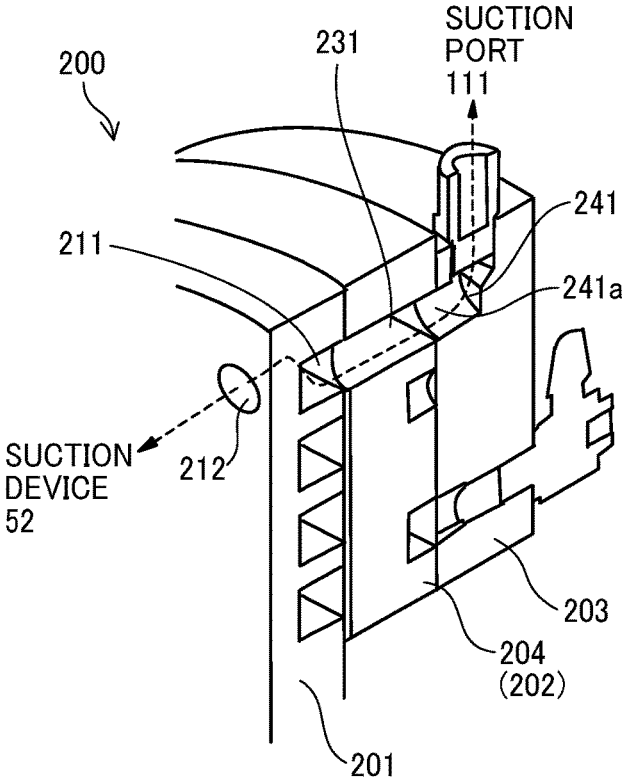
FIG. 36 is a schematic enlarged cross-sectional perspective view of a main part of the rotary valve cut in half.

FIG. 36 is a schematic enlarged cross-sectional perspective view of a main part of the rotary valve 200 cut in half.

Figure 37A:
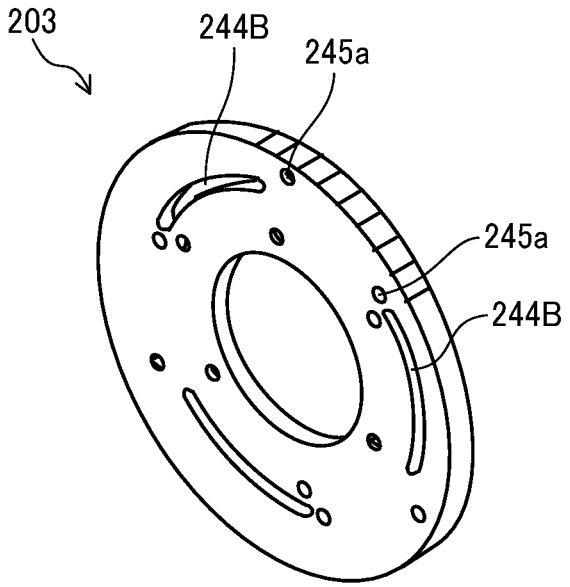
FIGS. 37A and 37B are schematic perspective views of a second member that configures the rotary valve.
Figure 37B:
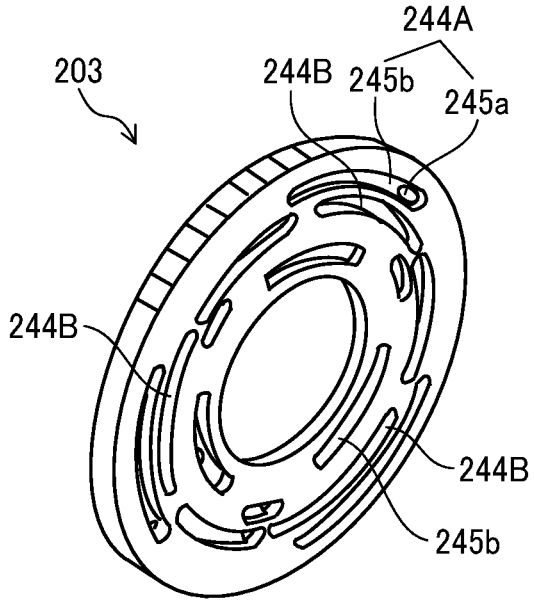

FIGS. 37A and 38B are schematic perspective views of a second member 204 that forms the rotary valve 200.

Figure 38:
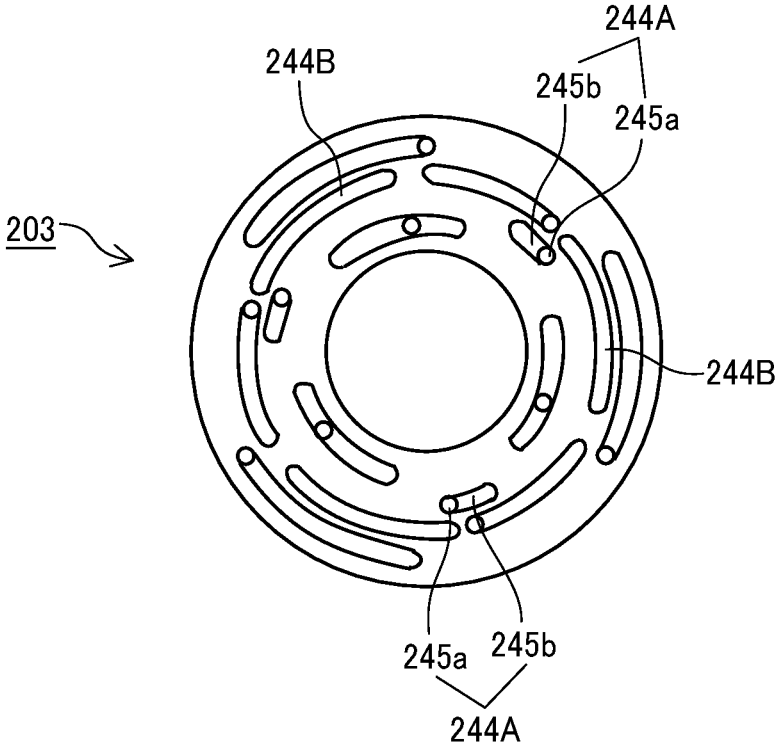
FIG. 38 is a schematic side view of the second member.

FIG. 38 is a side view of the second member 204.

The second member 204 according to the second embodiment includes a combination of the first member 203 and the third member 205 according to the first embodiment. Further, the first member 203 according to the second embodiment is the second member 204 according to the first embodiment.

As illustrated in FIG. 37A, the first member 203 includes a hole 244A on the side surface of the second member 204 (disk-shaped member). The hole 244A includes a through hole 245*a* and a groove 245*b* formed along the circumferential direction of the second member 204. The through hole 245*a* penetrates through the second member 204 in the axial direction of the second member 204. The groove 245*b* communicates with the through hole 245*a*.

The first member 203 further includes grooves 244B corresponding to each bearing region 105. The grooves 244B penetrate through the second member 204 in the axial direction of the first member 203. The grooves 244B are formed along the circumferential direction of the first member 203. The hole 244A and the grooves 244B, for example, are arranged at four locations on the concentric circles from the outer circumference toward the center in the radial direction of the first member 203.

Therefore, the second member 204 is rotate relative to the first member 203 to change the size of the suction region, that is the number of the suction holes 112 connected to the suction device 52, in the second embodiment of the present disclosure.

In the above-described embodiments, the first member 203 rotates together with the drum 51. Since a distance between the suction port 111 of the drum 51 and a connection port of the hose 56 of the rotation part 202 of the rotary valve 200 varies according to the rotation of the second member 204, the rotary valve 200 according to the second embodiment has a configuration of a piping adjustable according to a variation (change) of the distance between the suction port 111 and the connection port of the hose 56.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet suction device comprising:

a bearing member configured to bear a sheet on a circumferential surface of the bearing member and rotate;

a plurality of suction holes in a bearing region in the circumferential surface of the bearing member;

a suction device connected to the plurality of suction holes, the suction device configured to suck the sheet through the plurality of suction holes; and a rotary valve between the bearing member and the suction device;

wherein the rotary valve comprises:

a first member communicating with the suction device; and a second member contacting the first member, the second member communicating with the plurality of suction holes, the first member includes a first groove on a side surface in a circumferential direction of the first member, the first groove communicating with the suction device, the second member comprises:

a plurality of holes on one side surface arranged in a row in a circumferential direction of the second member, the plurality of holes communicating with the plurality of suction holes; and a second groove on another side surface in the circumferential direction of the second member, the second groove communicating with at least one of the plurality of holes of the second member, and the first member is rotatable relative to the second member to change a number of the plurality of holes of the second member connected to the first groove of the first member to change a number of the plurality of suction holes communicating with the suction device.

2. The sheet suction device according to claim 1, wherein:

the second member includes a plurality of hole rows in a radial direction of the second member, each of the plurality of hole rows including the plurality of holes arranged in the row, and the second groove communicates with at least one of the plurality of holes in an innermost hole row of the plurality of hole rows in the radial direction of the second member.

3. The sheet suction device according to claim 1, wherein the plurality of holes of the second member includes a non-through hole extending in a radial direction of the second member, and the non-through hole does not penetrate through the second member in an axial direction of the second member.

4. The sheet suction device according to claim 1, wherein the plurality of holes of the second member includes:

through holes penetrating through the second member in an axial direction of the second member; and non-through holes not penetrating through the second member in the axial direction of the second member, and the through holes and the non-through holes are alternately arranged in the circumferential direction of the second member.

5. The sheet suction device according to claim 1, wherein the bearing member is bearable a plurality of sheets on the circumferential surface in a circumferential direction of the bearing member.

6. The sheet suction device according to claim 1, wherein the first member and the second member rotate together with the bearing member.

7. The sheet suction device according to claim 1, wherein the first member is manually rotatable.

8. The sheet suction device according to claim 1, wherein the plurality of suction holes is arranged in a circumferential direction of the bearing member, and a rotation of the first member changes a number of the plurality of suction holes connected to the suction device in the circumferential direction of the bearing member.

9. The sheet suction device according to claim 1, wherein the plurality of suction holes is arranged in an axial direction of the bearing member, and a rotation of the first member changes a number of the plurality of suction holes connected to the suction device in the axial direction of the bearing member.

10. The sheet suction device according to claim 1, wherein each of the first member and the second member has a shape of a disk.

11. The sheet suction device according to claim 1, wherein one end of the second groove is connected to one of the plurality of holes, and another end of the second groove is adjacent to another of the plurality of holes adjacent to said one of the plurality of holes.

12. A conveyor comprising:

the sheet suction device according to claim 1, wherein the bearing member is configured to rotate and convey the sheet.

13. A printer comprising:

a liquid discharge device configured to discharge a liquid onto a sheet; and the sheet suction device according to claim 12.

14. A suction region changing device between a plurality of suction holes and a suction device, the suction region changing device comprising:

a first member communicating with the suction device; and a second member contacting the first member, the second member communicating with the plurality of suction holes, the first member includes a first groove on a side surface in a circumferential direction of the first member, the first groove communicating with the suction device, the second member comprises:

a plurality of holes on one side surface arranged in a row in a circumferential direction of the second member, the plurality of holes communicating with the plurality of suction holes; and a second groove on another side surface in the circumferential direction of the second member, the second groove communicating with at least one of the plurality of holes of the second member, and the first member is rotatable relative to the second member to change a number of the plurality of holes of the second member connected to the first groove of the first member to change a number of the plurality of suction holes communicating with the suction device.

15. A sheet suction device comprising:

a bearing member configured to bear a sheet on a circumferential surface of the bearing member and rotate;

a plurality of suction holes in a bearing region in the circumferential surface of the bearing member;

a suction device connected to the plurality of suction holes, the suction device configured to suck the sheet through the plurality of suction holes; and a rotary valve between the bearing member and the suction device;

wherein the rotary valve comprises:

a first member communicating with the plurality of suction holes; and a second member contacting the first member, the second member communicating with the suction device, the first member comprises:

a plurality of holes on one side surface arranged in a row in a circumferential direction of the first member, the plurality of holes communicating with the plurality of suction holes; and a first groove on another side surface in the circumferential direction of the first member, the first groove communicating with at least one of the plurality of holes of the first member, and the second member includes a second groove on a side surface in a circumferential direction of the second member, the second groove communicating with the suction device, the second member is rotatable relative to the first member to change a number of the plurality of holes of the first member connected to the second groove of the second member to change a number of the plurality of suction holes communicating with the suction device.

16. The sheet suction device according to claim 15, wherein the first member rotates together with the bearing member.

* * * * *